US007650105B2

(12) United States Patent
Ogawa et al.

(10) Patent No.: US 7,650,105 B2
(45) Date of Patent: Jan. 19, 2010

(54) IMAGE HEATING APPARATUS

(75) Inventors: Kenichi Ogawa, Numazu (JP); Akira Kato, Mishima (JP); Satoshi Nishida, Numazu (JP); Masashi Tanaka, Susono (JP); Atsuyoshi Abe, Susono (JP); Koji Uchiyama, Numazu (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 11/781,479

(22) Filed: Jul. 23, 2007

(65) Prior Publication Data

US 2008/0025771 A1 Jan. 31, 2008

(30) Foreign Application Priority Data

Jul. 27, 2006 (JP) ..... 2006-204238
Dec. 8, 2006 (JP) ..... 2006-332176
Jul. 13, 2007 (JP) ..... 2007-184600

(51) Int. Cl.
*G03G 15/20* (2006.01)

(52) U.S. Cl. ..... 399/327; 399/328; 399/330

(58) Field of Classification Search ..... 399/326, 399/327, 328, 330
See application file for complete search history.

(56) References Cited

U.S. PATENT DOCUMENTS 5,149,941 A 9/1992 Hirabayashi et al.
5,300,997 A 4/1994 Hirabayashi et al.
5,343,280 A 8/1994 Hirabayashi et al.
5,767,484 A 6/1998 Hirabayashi et al.
6,763,205 B2 7/2004 Izawa et al.
7,155,136 B2 12/2006 Nihonyanagi et al.
7,190,914 B2 3/2007 Nihonyanagi et al.
7,193,181 B2 3/2007 Makihira et al. ..... 219/216
7,200,355 B2 4/2007 Uchiyama et al. ..... 399/333
7,203,438 B2 4/2007 Omata et al. ..... 399/69
7,283,145 B2 10/2007 Kato et al. ..... 347/156
2003/0077092 A1 4/2003 Ogawa et al. ..... 399/328
2005/0214043 A1 * 9/2005 Kameda ..... 399/328
2006/0045589 A1 3/2006 Iwasaki et al. ..... 399/328
2006/0051117 A1 3/2006 Nishida ..... 399/69
2007/0098465 A1 5/2007 Aoki et al. ..... 399/328

FOREIGN PATENT DOCUMENTS

JP 63-313182 12/1988
JP 4-186271 7/1992
JP 5-113736 5/1993
JP 11-007216 1/1999
JP 2001-201973 7/2001

(Continued)

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

An image heating apparatus for heating a toner image formed on a recording material is constituted by a roller contactable with a toner image carrying surface of the recording material; a heating member for heating the roller, the heating member contacting a surface of the roller, wherein the toner image formed on the recording material is heated in contact with the roller; and a driving mechanism for moving the heating member to a first position contacting the roller and a second position, contacting the roller different from the first position with respect to a tangential direction of the roller.

6 Claims, 17 Drawing Sheets

FOREIGN PATENT DOCUMENTS

| | | |
|---|---|---|
| JP | 2002-236426 | 8/2002 |
| JP | 2003-186327 | 7/2003 |
| JP | 2004-177888 | 6/2004 |
| JP | 2005-250452 | 9/2005 |
| JP | 2005-250453 | 9/2005 |

* cited by examiner

IMAGE HEATING APPARATUS

FIELD OF THE INVENTION AND RELATED ART

The present invention relates to an image heating apparatus suitable for a heat-fixing device mounted to a copying machine or a printer, particularly an image heating apparatus including a roller contactable with a toner image and a heating member contacting a surface of the roller.

U.S. Pat. No. 6,763,205 (Japanese Laid-Open Patent Application (JP-A) 2003-186327) has proposed a constitution in which a roller contacting a toner image is heated from a surface side of the roller and heat accumulated at the roller surface is imparted to the toner image to heat the toner image. An image heating apparatus of this type (external heating type) is not required to be warmed at an inner portion of the roller so that it has an advantage such that thermal capacity is low and thus electric power consumption can be reduced.

The external heating type image heating apparatus is classified into a constitution in which the heating member contacts the roller and a constitution in which the heating member does not contact the roller. The contact type image heating apparatus is preferable to the non-contact type image heating apparatus since it has better heat transfer efficiency from the heating member to the roller.

However, in the case of the contact type image heating apparatus, there arises such a problem that toner transferred from a recording material onto the roller is liable to be deposited on the heating member. Agglomerative toner deposited and grown considerably is abruptly discharged onto the roller surface to cause a problem of contamination or the like of the recording material during a heating step of the toner image. When a cleaner for removing the toner deposited on the heating member is provided, a cost is increased correspondingly.

U.S. Pat. No. 7,190,914 (JP-A 2005-250452) has disclosed a technique in which a heating member is heated in a state in which rotation of a roller to be heated by the heating member is stopped and thereafter toner deposited on the heating member is fixed on the roller by cooling a heating area to remove the toner from the heating member. Further, U.S. Pat. No. 7,155,136 (JP-A 2005-250453) has disclosed a technique in which a roller to be heated by a heating member is rotated normally and reversely in a heated state of the heating member to wipe the toner deposit on the heating member with the toner.

SUMMARY OF THE INVENTION

In view of the above described circumstances, a principal object of the present invention is to provide an image heating apparatus capable of more effectively removing toner deposited on a heating member compared with the conventional techniques.

Another object of the present invention is to provide an image heating apparatus capable of removing toner deposited in the neighborhood of an edge of the heating member.

According to an aspect of the present invention, there is provided an image heating apparatus for heating a toner image formed on a recording material, comprising:

a roller contactable with a toner image carrying surface of the recording material;

a heating member for heating the roller, the heating member contacting a surface of the roller, wherein the toner image formed on the recording material is heated in contact with the roller; and a driving mechanism for moving the heating member to a first position contacting the roller and a second position, contacting the roller different from the first position with respect to a tangential direction of the roller.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
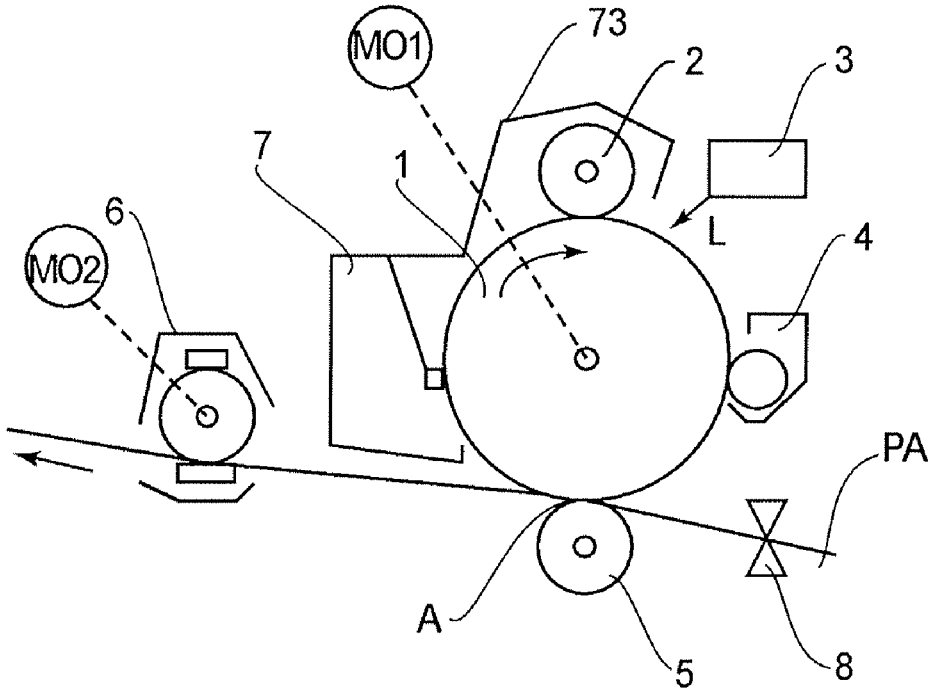
FIG. 1 is a schematic view of an image forming apparatus in which the image heating apparatus according to the present invention is mounted as a fixing apparatus.

An image heating apparatus according to the present invention will be described with reference to the drawings. FIG. 1 is a schematic view of an image forming apparatus to which the image heating apparatus of the present invention is mounted. Referring to FIG. 1, the image forming apparatus in this embodiment is a laser beam printer utilizing a transfer type electrophotographic process.

The image forming apparatus includes image forming means including a process cartridge 73, a laser scanner 3, a transfer roller 5, and a heat-fixing apparatus 6. The process cartridge 73 is detachably (replaceably) mountable to a main assembly of the image forming apparatus. In this embodiment, the process cartridge 73 includes four process means consisting of an electrophotographic photosensitive member 1 (hereinafter referred to as a "photosensitive drum"), a charging roller 2, a developing apparatus 4, and a cleaning apparatus 7. The photosensitive drum 1, the charging roller 2, and a developing roller in the developing apparatus 4 are rotated by receiving power from a motor MO1. The main motor MO1 also drives rollers or the like for conveying a recording material. In the laser scanner 3, a polygon mirror for performing polarization scanning of laser light is provided and is rotated by receiving power from a scanner motor mounted in the laser scanner 3.

The photosensitive drum 1 is prepared by forming a photosensitive material such as an organic photoconductor (OPC), amorphous selenium (Se), or amorphous silicon (Si) on a cylindrical substrate of aluminum or nickel. The photosensitive drum 1 is rotationally driven in a clockwise direction indicated by an arrow at a predetermined peripheral speed and electrically charged uniformly to a predetermined polarity and a predetermined potential by the charging roller 2 as a charging apparatus.

Thereafter, with respect to the charged surface of the photosensitive drum 1, light exposure for writing image information is performed by the laser scanner 3. More specifically, the laser scanner 3 performs scanning exposure of the uniformly charged surface of the photosensitive drum with a laser beam L which is ON/OFF-controlled (modulation-controlled) depending on a time-serial electrical digital pixel signal as the image information. As a result, a potential of a light exposure portion at the uniformly charged surface of the photosensitive drum 1 is attenuated, so that an electrostatic latent image corresponding to the image information is formed on the surface of the photosensitive drum 1.

The electrostatic latent image is developed as a toner image by the developing apparatus 4. As a developing method, a jumping developing method, a two-component developing method, an FEED developing method, or the like is used. In many cases, a combination of imagewise light exposure and a reverse developing method is employed.

The toner image is transferred from the surface of the photosensitive drum 1 onto a surface of a recording material PA fed to a transfer nip A. The transfer nip A is a press-contact portion between the photosensitive drum 1 and the transfer roller 5 as a contact transfer apparatus contacting the photosensitive drum 1. The recording material PA is fed from an unshown feeding mechanism portion to the transfer nip A at predetermined timing. More specifically, the timing is adjusted by detecting a leading end of the recording material PA with a sensor 8 so that an image forming position of the toner image on the photosensitive drum 1 coincides with a writing position of the leading end of the recording material PA. The recording material PA fed at the predetermined timing is nipped and conveyed in the transfer nip A between the photosensitive drum 1 and the transfer roller 5 with a certain pressing force, so that the toner image on the surface of the photosensitive drum 1 is transferred onto the recording material PA by an electric force and a pressure.

The recording material PA passing through the transfer nip A is separated from the surface of the rotating photosensitive drum 1 and conveyed to the heat-fixing apparatus 6 in which an unfixed toner image is heat-fixed as a permanent image on the recording material surface. The recording material PA subjected to the image fixation is conveyed to a sheet discharge portion.

Transfer residual toner remaining on the photosensitive drum 1 after the separation of the recording material therefrom is removed from the surface of the photosensitive drum 1 by the cleaning apparatus 7 and the photosensitive drum 1 is repetitively subjected to image formation.

[Heat-Fixing Apparatus (Image Heating Apparatus) 6]

Figure 2:
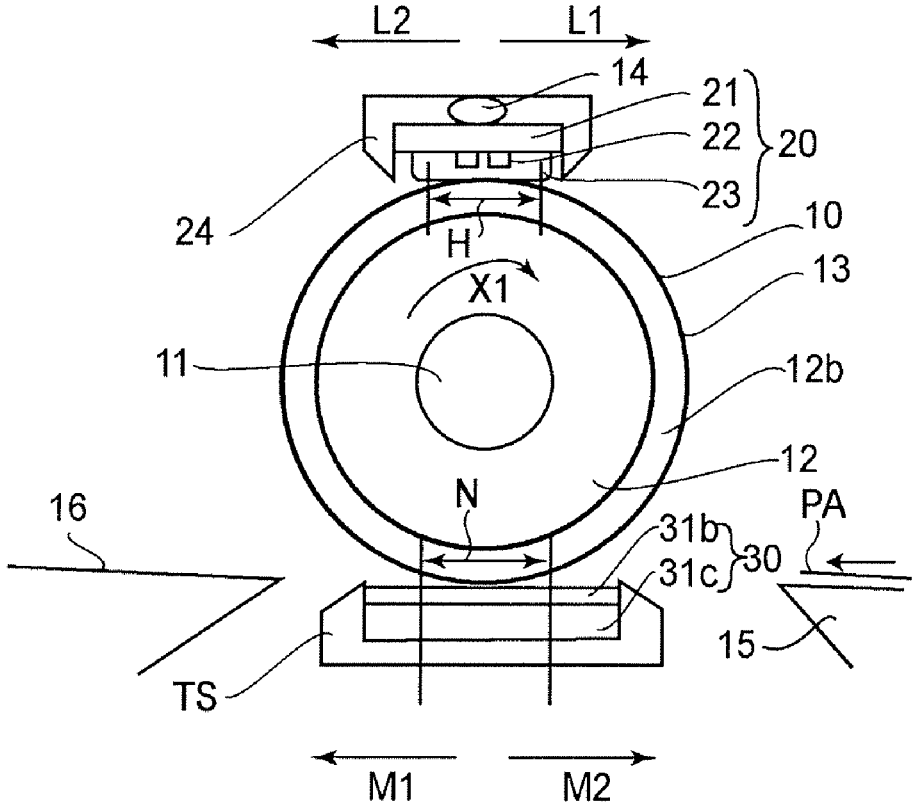
FIG. 2 is a constitutional view of an image forming apparatus in Embodiment 1.

FIG. 2 is an enlarged schematic view of the heat-fixing apparatus 6 in this embodiment. As shown in FIG. 2, the heat-fixing apparatus 6 is roughly constituted by a fixing roller 10, a heating member 20 contacting a surface of the fixing roller 10, and a pressing member 30. The fixing roller 10 is rotated by receiving power from a motor MO2 for a fixing unit. The fixing unit motor MO2 is a motor capable of being rotated normally and reversely, thus being rotatable in a rotational direction during fixation (normal rotation) (in X1 direction indicated by an arrow in FIG. 4(*a*)) and in a direction (reverse rotation) in X2 direction indicated by an arrow in FIG. 4(*b*)).

The fixing roller 10 has an elastic layer. The heating member 20 contacts the fixing roller 10 to form a heating nip H, thus heating the fixing roller 10. The pressing member 30 and the fixing roller 10 mutually contact to form a fixing nip (conveying nip) N. The heating nip is an area in which the fixing roller 10 and the heating member 20 contact each other, and the fixing nip is an area in which the fixing roller 10 and the pressing member 30 contact each other.

The heating member 20 is held in a recess of a holder 24 for holding the heating member 20. The heating member 24 is fixed to a main assembly of the heat-fixing apparatus 6 so as not to move both in L1 direction and in L2 direction. Further, the fixing roller 10 is also fixed to the main assembly of the heat-fixing apparatus 6 in a rotatable state so as not to move both in the L1 and L2 directions.

Figure 4:
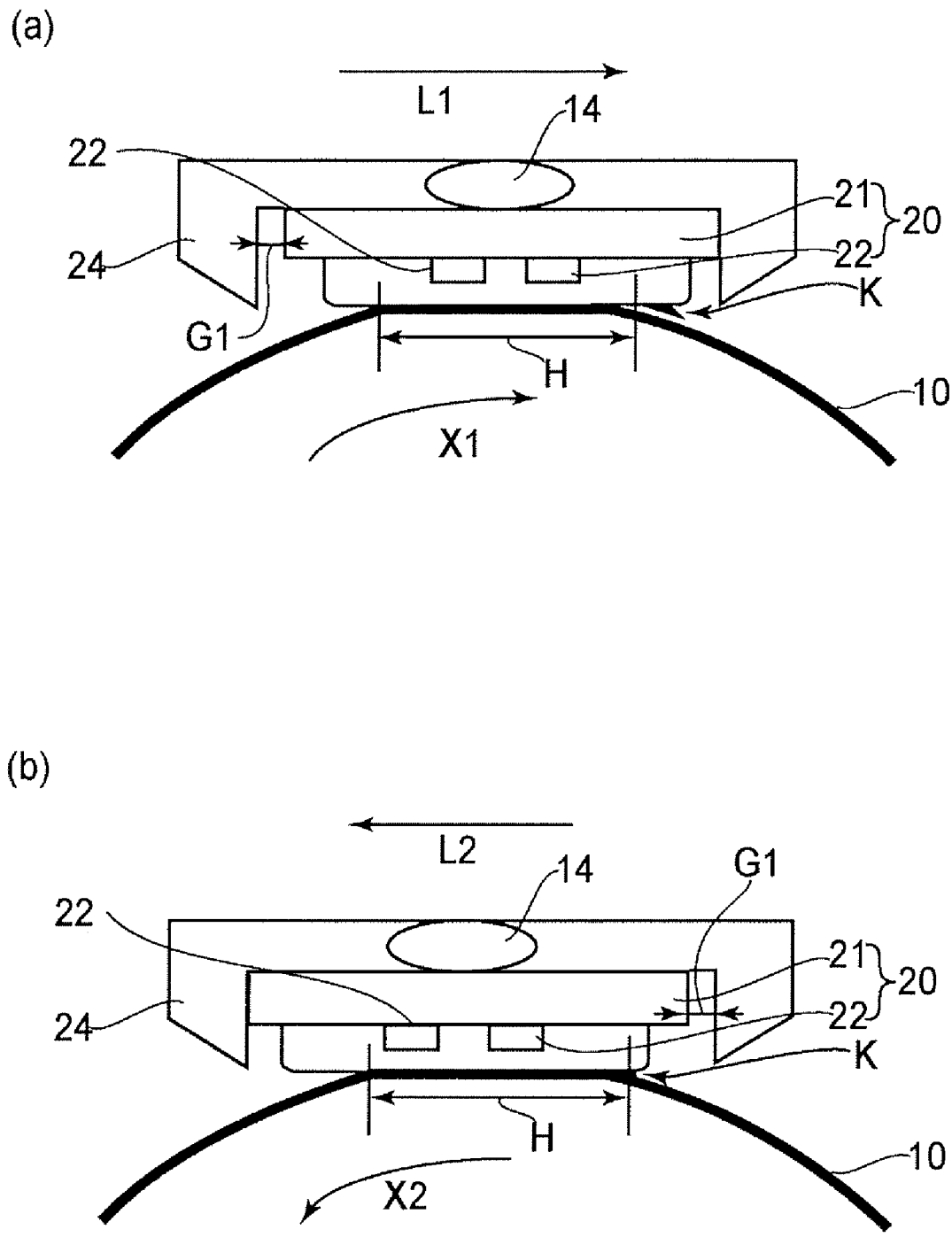
FIGS. 4(*a*) and 4(*b*) are schematic views showing positional relationships between a heating member and a fixing roller when the fixing roller is rotated normally (FIG. 4(*a*)) and reversely (FIG. 4(*b*)).

In the recess of the holder 24, a gap G1 (FIG. 4(*a*)) and 4(*b*)) is provided between the heating member 20 and the holder 24 so that the heating member 20 is movable in the L1 and L2 directions in the recess of the holder 24.

[Fixing Roller 10]

The fixing roller 10 is basically prepared by subjecting an outer surface of a core metal 11 formed of aluminum or iron to surface-roughening process such as blasting and thereafter providing an elastic layer 12 on the outer surface of the core metal 11.

The elastic layer 12 is a sponge rubber layer of foamed silicone rubber or a foam rubber layer including a silicone rubber layer and hollow filler dispersed therein, thus being improved in a heat insulating function by ensuring a gas portion in the rubber layer.

When the fixing roller 10 has a larger thermal capacity and any larger thermal conductivity, the fixing roller 10 is liable to absorb therein heat from the outer surface of an external heating member 21, so that a surface temperature of the fixing roller 10 is less liable to be increased. For this reason, the elastic layer 12 is formed of a material such that it has a thermal capacity and a thermal conductivity as low as possible and has a high heat insulating effect, so that a rise time of the fixing roller 10 is shortened.

The thermal conductivities of the sponge rubber and the foam rubber are 0.10-0.16 W/(m·k), which is about half of that of a solid rubber. Values of specific gravity, associated with the thermal capacity, of the sponge rubber and the foam rubber are about 0.75-0.85. Accordingly, in a preferred embodiment, the elastic layer 12 of the fixing roller 10 is a sponge rubber layer or foam rubber layer having a low thermal conductivity of 0.15 W/(m·k) or less and a high heat insulating effect in terms of specific gravity of 0.85 or less.

A small outer diameter of the fixing roller 10 can be effective in suppressing the thermal capacity but when the outer diameter is excessively small, the widths of the heating nip and fixing nip are less liable to be ensured. For this reason, the fixing roller 10 requires a proper outer diameter. With respect to the thickness of the elastic layer 12, a proper thickness is required since an excessively small thickness leads to dissipation of heat into the core metal 11.

In view of the above requirements, in this embodiment, the elastic layer 12 is formed of a foam rubber layer having a thickness of 2 mm and a fixing roller 10 having an outer diameter of 14 mm is used in order to form a proper heat nip H and suppress the thermal capacity.

As the hollow filler in the core metal 11, it is possible to use any material, such as glass balloon, silica balloon, carbon balloon, phenol balloon, acrylonitrile balloon, vinylidene chloride balloon, alumina balloon, zirconia balloon, or Shirasu balloon.

The core metal 11 may also be a hollow core metal. On the elastic layer 12, a heat transfer layer 12*b* (solid rubber layer) which is formed of silicone rubber and has a heat transfer effect is disposed. The heat transfer layer 12*b* has a thermal conductivity of 0.50-1.60 W/(m·k) and a specific gravity of about 1.05-1.30.

In the case where the heat transfer layer 12*b* has a small thickness, the heat transfer effect and the heat capacity are decreased, so that a heat accumulating effect is not achieved. On the other hand, when the thickness is increased, the heat accumulating effect and the heat transfer effect are achieved but heat from a heat generating element 22 is conducted to the inside of the fixing roller 10, thus being accumulated in the fixing roller 10 to lead to a poor thermal efficiency. Accordingly, the thickness of the heat transfer layer 12*b* may preferably 0.1-0.30 mm, more preferably about 0.15 mm.

On the heat transfer layer 12*b*, a parting layer 13 formed of a fluorine-containing resin material such as perfluoroalkoxy (PFA) resin, polytetrafluoroethylene (PTFE) resin, or tetrafluoroethylene-hexafluoropropylene (FEP) resin is formed. Alternatively, it is possible to effect coating of the heat transfer layer 12*b* with GLS latex. The parting layer 13 may have a tube-like shape or may be coated with paint.

[Heating Member 20]

The heating member 20 includes a plate-like substrate 21 and a heat generating resistor 22 formed on the substrate 21. The substrate 21 is an insulating ceramic substrate formed of alumina or aluminum nitride or a heat resistive substrate formed of polyimide, PPS, a liquid crystal polymer, etc. The heat generating resistor 22 is, e.g., prepared by coating a surface of the substrate 21 with a paste of a material such a silver-palladium (Ag/Pd), $RuO_2$, or TaN along a longitudinal direction of the substrate 21 by screen printing and thereafter sintering the paste. The heat generating resistor 22 has an elongated shape having a thickness of about 10 μm, a width of about 1-5 mm, and a length of about 300 mm.

The heating member 20 may further include a protective layer 23 for protecting the heat generating resistor 22 within bounds of not impairing the thermal efficiency. However, the thickness of the protective layer 23 may preferably be a sufficient small to the extent that a surface property is improved. Examples of the protective layer 23 may include a layer of fluorine-containing resin such as perfluoroalkoxy (PFA) resin, polytetrafluoroethylene (PTFE) resin, tetrafluoroethylene-hexafluoropropylene (FEP) resin, ethylenetetrafluoroethylene (ETFE) resin, polychlorotrifluoroethylene (CTFE) resin, and polyvinylidene fluoride (PVDF), which are coated singly or in mixture. Alternatively, it is also possible to use a protective layer formed of a dry coating lubricant such as graphite, diamond-like carbon (DLC), or molybdenum disulfide, and formed of a glass coating material.

In the case where aluminum nitride or the like having a good thermal conductivity is used as a material for the substrate 21, the heat generating resistor 22 may also be formed on the substrate 21 at a surface opposite from a surface facing the fixing roller 10.

In this embodiment, the substrate 21, the heat generating resistor 22, and the protective layer constitute one component, i.e., a heater 20. Thus heater 20 directly contacts the fixing roller 10 to form the heating nip (heating area) H.

The heating member holder 24 is formed of a heat resistive resin material such as a liquid crystal polymer, phenolic resin, PPS, or PEEK, and a thermal efficiency with respect to heat at the fixing roller surface is increased with a decreasing thermal conductivity. Thus, the heating member holder 24 may also contain hollow filler such as glass balloon or silica balloon in the resin layer.

In the heater 20, a temperature detecting device 14 such as a thermistor for detecting a temperature of the heating member 20 is disposed at a surface opposite from the surface facing the fixing roller 10. The temperature detecting device 14 is provided for the purpose of controlling the temperature of the heating member 20 or monitoring abnormal temperature rise of the heating member 20.

When the temperature detecting device 14 is used for temperature control, depending on a signal from the temperature detecting device 14, a duty ratio or a wave number of a voltage applied from an unshown electrode portion at a longitudinal end portion to the heat generating resistor 22 is appropriately controlled. As a result, the heat generating resistor 22 is heated to heat and temperature-control the surface of the fixing roller 10.

[Pressing Member 30]

The pressing member 30 is prepared by adhering a heat resistive sheet 31*b* to a heat resistive pad 31*c*.

The heat resistive sheet 31*b* is a film-like sheet having a heat resistivity and a slidability and has an appropriate thickness in a range of 20 μm or more and less than 200 μm in view of a film strength or the like.

On a surface of the sheet 31*b*, it is also possible to coat a layer of a heat resistive resin material, having good releasability and slidability, such as PFA, PTFE, FEP, or silicone resin, singly or in mixture. As a result, offset toner deposited on the fixing roller 10 can be efficiently removed with reliability, so that it is possible to obtain a good image by suppressing contamination of the fixing roller 10.

The pressing member 30 is mounted in a recess of a holder TS fixed to a frame of the fixing apparatus. In the recess, a gap G2 (FIGS. 5(*a*) and 5(*b*)) is provided between the pressing member 30 and the holder TS so that the pressing member 30 is movable in the recess in a direction (M1 direction in FIG. 2) identical to the recording material conveying direction and an opposite direction (M2 in FIG. 2). Further, the pressing member 30 is pressed against the fixing roller 10 together with the holder TS by an unshown urging means, so that the fixing nip N required for fixation is created between the pressing member 30 and the fixing roller 10.

The pad 31*c* holds the heat resistive sheet 31*b* and is suitably formed with a member having the heat resistivity and slidability including the heat resistive resin material such as the liquid crystal polymer, the phenolic resin, PPS, or PEEK.

[Operation of Heat-Fixing Apparatus]

In the above-constituted heat-fixing apparatus 6, the fixing roller 10 is rotationally driven in a clockwise direction indicated by an arrow (X1 direction) during fixation with the core metal 11 as a rotational axis in a longitudinal direction thereof. Further, by energizing the heat generating resistor 22, the heater 20 is quickly increased in temperature. The energization of the heat generating resistor 22 is controlled by a control circuit including the temperature detecting device 14 so that the heater 20 is kept at a predetermined (set) temperature.

By the heat generation of the heat generating resistor 22, the outer surface of the fixing roller 10 is heated. It is also possible to heat the fixing roller 10 through a sheet-like sliding member disposed between the outer surface of the fixing roller 10 and the heater 20. However, the constitution of omitting the sliding member can provide an inexpensive heat-fixing apparatus. In the case where the heater 20 directly contacts the fixing roller 10 as in this embodiment, the heater 20 corresponds to the heating member. On the other hand, in the case where the sliding member is interposed between the heater 20 and the fixing roller 10, the heater 20 and the sliding member constitute the heating member in combination or the sliding member alone constitutes the heating member.

In such a state, the recording material PA on which the unfixed toner image is formed and carried is conveyed, along a fixing entrance guide 15, to the fixing nip N created between the fixing roller 10 and the pressing member 30. Then, the unfixed toner image on the recording material PA is fixed by heat and pressure.

Figure 8:
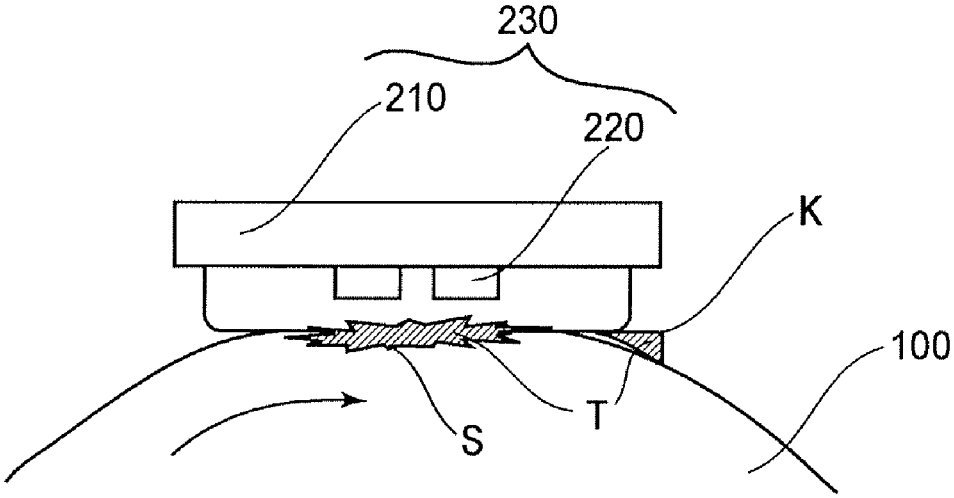
FIG. 8 is a schematic view for illustrating toner contamination in the neighborhood of a heat nip.

A difference between the above described heat-fixing apparatus 6 and a heat-fixing apparatus of Comparative Embodiment will be described. FIG. 8 is en enlarged view showing a heating portion (a contact area H between a fixing roller 100 and a heater 230) and its neighborhood of the heat-fixing apparatus in Comparative Embodiment.

In the case where toner T which cannot be fixed on the recording material is located on the surface of the fixing roller 100, the toner T van be deposited on a contact surface of the heating member 230 press-contacting the fixing roller 100 or at an upstream side end portion or a downstream-side end portion.

As shown in FIG. 8, a deposition portion of the toner T can be located in a contact area S or principally located in an area K at the downstream-side end portion of the heating member 23 with respect to the rotational direction of the fixing roller 100. In this state, when the fixation of the toner image is continued, the toner T deposited on the heating member 230 somewhat rubs the fixing roller surface, thus always leading to contamination of the fixing roller 100.

Further, the toner T deposited on the heating member 230 intimately contacts and rubs the fixing roller 100 to damage of the surface of the fixing roller 100 with respect to a circumferential direction of the fixing roller 100.

Further, large agglomerative toner T deposited in the area K can cause a defective image by accidentally falling on the recording material. The reason why the toner is liable to be deposited in the K is that a relative positional relationship between the heating member 230 and the fixing roller 100 is always fixed and a rotational direction of the fixing roller 100 is always the same direction.

Figure 9:
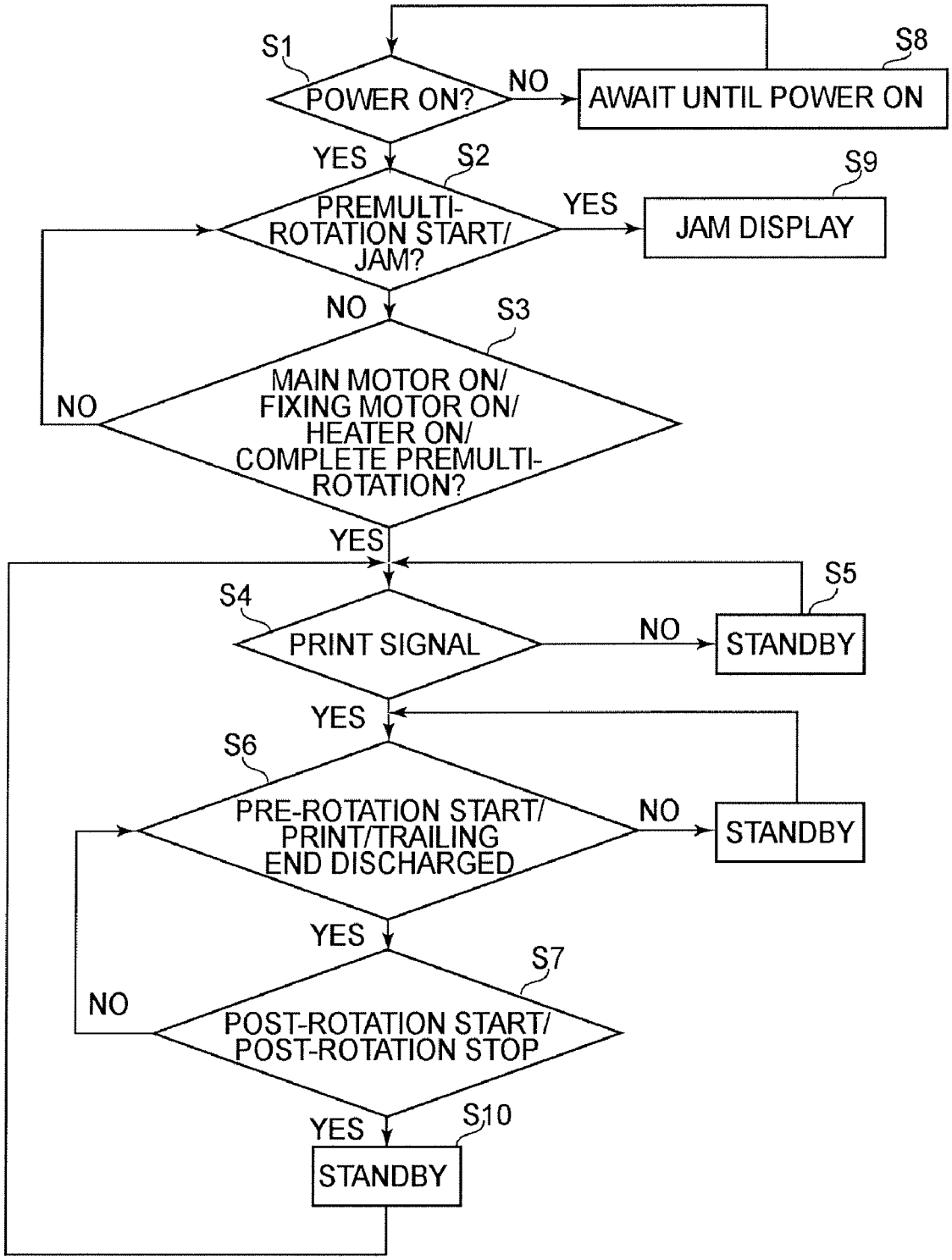
FIG. 9 is a flow chart showing an operation of an image forming apparatus in Comparative Embodiment.

FIG. 9 is a flow chart showing a print sequence of an image forming apparatus to which the heat-fixing apparatus in Comparative Embodiment is mounted. Referring to FIG. 9, in the sequence in Comparative Embodiment, an operation which is called premulti-rotation for performing initial checking of an apparatus itself immediately after electric power is turned on is effected (S1 and S2). The premulti-rotation is a rotation operation of a photosensitive member 1 or the fixing roller 100 performed during a preparatory operation from turning-on of a printer until the printer is placed in a printable state. During the premulti-rotation, a main motor and a motor for a fixing unit are started to be rotated, so that the fixing roller 100 is rotated in a direction in which the recording material PA is conveyed. At the same time as the operation, energization of the heating member 230 is also started, so that the heating member 230 is increased in temperature up to a set temperature suitable for a fixing process. This set temperature is ordinarily in a range of 150-210° C. After the premulti-rotation is completed, the image forming apparatus is in a standby state in the case of no print signal (print instruction), so that the main motor and the fixing unit motor are stopped until the print signal is provided. At the same time, the energization of the heating member 230 is also completed (S3 to S5).

When a print start instruction is provided from a host computer, the sequence goes to pre-rotation which is an operation for print (S6). When this operation is started, the rotation operations of the main motor and the fixing unit motor are started and at the same time, energization of the heating member 230 is also started. At this time, the heating member 230 is kept at a set temperature capable of fixing the toner on the recording material while being subjected to temperature detection by the temperature detection device 14.

When the preparation of the printer is completed, the recording material is fed by a feeding roller and a toner image is transferred onto the recording material at a transfer portion, and the recording material is conveyed to the heat-fixing apparatus.

When the fixing process is completed, the sequence goes to a post-processing sequence of the apparatus which is called post-rotation (S7). The post-processing sequence is an operation for scraping the toner T remaining on the photosensitive drum and cooling the heat-fixing apparatus. In the case where this operation is completed, rotations of the main motor and the fixing unit motor are stopped and the image forming apparatus is returned to the state immediately after the electric power is turned on.

The above sequence is described for an ordinary print operation state but in other states in which a jam occurs and continuous printing is performed, a sequence in which the main motor and the fixing unit motor are stopped (S8 to S10).

This Embodiment

Figure 3:
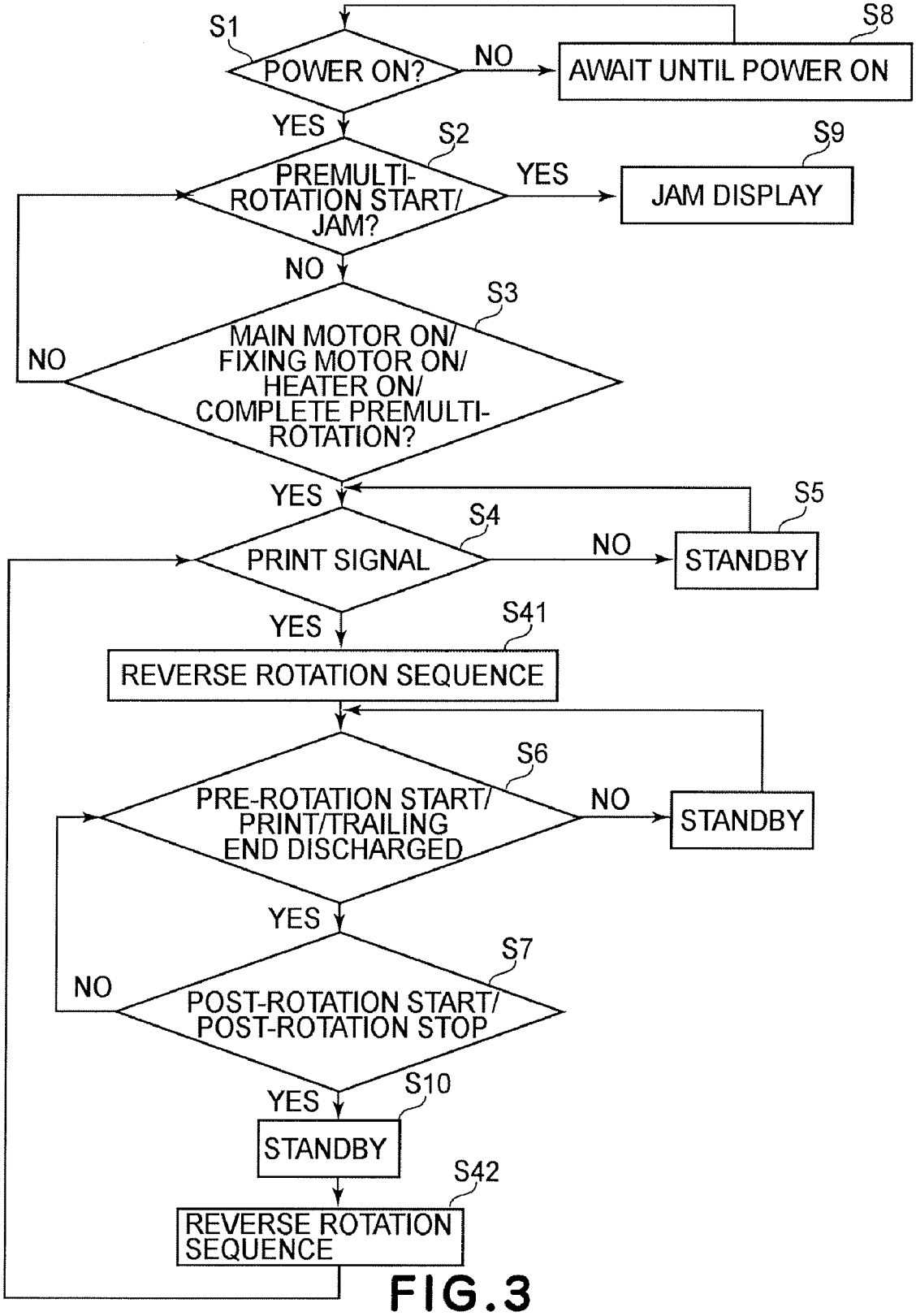
FIG. 3 is a flow chart showing an operation of an image forming apparatus in Embodiment 1.

Next, a print sequence of an image forming apparatus to which the heat-fixing apparatus of this embodiment is mounted will be described. FIG. 3 is a flow chart showing the print sequence in this embodiment. FIG. 4(*a*) is a schematic view showing a positional relationship between the heater 20 and the fixing roller 10 when the fixing roller 10 is normally rotated (X1 direction) and a positional relationship between the heater 20 and the holder 24. FIG. 4(*b*) is a schematic view showing a positional relationship between the heater 20 and the fixing roller 10 when the fixing roller 10 is reversely rotated (X2 direction) and a positional relationship between the heater 20 and the holder 24.

Referring to FIG. 3, the heat-fixing apparatus 6 is characterized in that the heater 20 is moved in L2 direction by reversely rotating the fixing unit motor MO2 in a small amount after the fixing unit motor MO2 is stopped (S41 and S42). Incidentally, the main motor is not rotated reversely.

In the sequence of this embodiment, during the motor stop (after S4) after the premulti-rotation performed during the turning-on of electric power, the fixing unit motor MO2 is reversely rotated (S41). Further, during the motor stop (after S10) after the post-rotation performed after completion of the print, the fixing unit motor MO2 is reversely rotated (S42).

During the premulti-rotation or the fixing process after electric power of the printer is turned on, the fixing roller 10 is rotated in X1 direction shown in FIG. 4(*a*). Since the gap G1 is preset between the holder 24 and the heater 20, so that the heater 20 is moved in L1 direction when the fixing roller 10 is heated in X1 direction. When the fixing roller 10 is continuously rotated in X1 direction, the toner offset from the recording material PA onto the surface of the fixing roller 10 is gradually deposited at a position (area) K shown in FIG. 4(*a*).

However, in this embodiment, the gap G1 is provided between the holder 24 and the heater 20 as described above and the fixing roller 10 is reversely rotated (X2 direction) to move the heater 20 in L2 direction as shown in FIG. 4(*b*). By this movement, the toner deposited in the area K enters the area of the heating nip H to melt the toner by heat of the heater 20 at predetermined timing to return the toner to the fixing roller 10, so that the toner is prevented from excessively depositing on the heater 20.

Here, assuming that the position of the heating member shown in FIG. 4(*a*) is a first position and the position of the heating member shown in FIG. 4(*b*) is a second position, the heating member is moved to the first position at which it contacts the fixing roller 10 and the second position, at which it contacts the fixing roller 10, different from the first position in tangential direction of the fixing roller 10. The second position is located upstream from the first position with respect to the rotational direction of the fixing roller 10 during the toner image heating.

In this embodiment, the fixing roller 10 is rotatable normally (X1 direction) and reversely (X2 direction). This fixing roller 10 function as a part of the driving mechanism for moving the heating member, so that the heating member is moved to the first position or the second position depending on a force receiving from the fixing roller 10. The heating member is located at the first position during the toner image heating and moved from the first position to the second position in periods (e.g., during print signal receiving and during standby state after the printing) other than the heating period.

In this embodiment, the fixing unit motor is reversely rotated so that the heater 20 is moved by a distance of the gap G. In this embodiment, the heating nip has a width of about 3 mm with respect to the rotational direction of the fixing roller 10 and the gap G is 1 mm. Even when the heater 20 is moved 1 mm, the heat generating resistor 22 of the heater 20 does not come out of the heating nip H.

As described above, the heating member is held by the holder and between the holder and the heating member, the gap for moving the heating member to the first position and the second position is provided.

The heating member includes the substrate and the heat generating resistor formed on the substrate and the heat generating resistor is constituted so as not to come out of the contact area between the heating member and the fixing roller both at the time when it is located at the first position and at the time when it is located at the second position.

As shown in FIG. 4(*b*), the area K is moved within the heat nip H by the reverse rotation performed immediately after the motor stop. In other words, the contact area of the heater 20 with the fixing roller 10 is different between during the normal rotation and during the reverse rotation.

When the heater 20 is moved to the position shown in FIG. 4(*b*), the heat-fixing apparatus is stopped but thereafter when the print signal is provided, energization of the heat generating resistor 22 is started at the same time as the motor rotation. At this time, toner or paper dust deposited on the heater (heating member) side in the area K is transferred to the fixing roller side. This is because the heater side surface of the toner sandwiched between the heater 20 and the fixing roller 10 is heated by the heater 20 for a fraction of time to be melted, thus being lowered in deposition force with respect to the heater.

When the recording material PA reaches the fixing nip N, the toner continuously conveyed by the rotation of the fixing roller while being deposited on the fixing roller surface is transferred and fixed onto the upper surface of the conveyed recording material PA to be discharged out of the heat-fixing apparatus. By moving the heater 20 to the position shown in FIG. 4(*b*) every time when the premulti-rotation after turning-on of the power of the printer is completed or when the fixing process operation (printing operation) is completed, a resultant image is not adversely affected by the toner or paper dust deposited on the recording material since an amount of the toner or paper dust deposited on the heater 20 in the area K is very small.

By repeating this sequence, the area K of the heater 20 is kept good, so that a good image is printed.

However, the above-described reverse rotation sequence is not always performed when the motor is stopped. In an emergency stop state such as jamming or the like, the reverse rotation sequence must not be performed. For example, in the emergency stop state, in the neighborhood of the fixing nip N, unfixed toner in a state in which both heat and pressure have not been applied is located in some cases. In such cases, when the reverse rotation sequence is performed, a large amount of the unfixed toner is deposited on the fixing roller surface, so that there is a possibility that the unfixed toner adversely affects the fixing roller 10 and the heater 20.

Here, a state after the reverse rotation sequence will be described. In this embodiment, by performing the reverse rotation sequence, the heater 20 is moved about 1.0 mm.

However, by normally rotating the fixing roller after the reverse rotation sequence, the amount of movement is reset, so that the position of the heater 20 is returned to the ordinary position at which the heater 20 is located before the reverse rotation.

The change in position of the heater 20 by the normal rotation and the reverse rotation is due to its frictional force against the fixing roller 10.

[Fixing Pressing Member]

The fixed pressing member 30 as a fixed backup means will be described. The fixed pressing member also slidably contacts the fixing roller 10 and is constituted so that the recording material PA is conveyed between the fixed pressing member and the fixing roller 10.

As described above, on the surface of the pressing member 30, the fluorine-based sheet having good releasability is provided but the toner is deposited with an increase in number of printed sheets, so that the pressing member 30 is contaminated in some cases.

However, basically, the toner deposited on the pressing member is discharged as a small contaminant while being gradually deposited on a leading end of the recording material PA by causing the recording material PA to pass between the fixing roller 10 and the pressing member 30. Thus, the discharged toner is not recognized as image failure on the recording material. Further, the amount itself of the toner deposited on the pressing member is very small.

Nevertheless, the toner is deposited on the pressing member 30. In the one-directional rotation sequence as in Comparative Embodiment, similarly as in the case of the heater 20, the toner is deposited on the pressing member 30 on a downstream side with respect to the rotational direction of the fixing roller 10 (a position P shown in FIG. 5(*a*)) in many cases. The thus deposited toner is still remaining on the pressing member 30 without being removed by the recording material PA. The toner deposited at the position P impairs conveyance of the recording material PA and can cause jamming (an abnormal state in which the recording material remains in the heat-fixing apparatus and cannot be outputted).

In this case, by using the reverse rotation sequence, it is possible to remove the deposited toner similarly as in the case of removing the toner from the heater 20. The pressing member is movable by a small gap G2 during the reverse rotation of the fixing roller 10 since the gap G2 is provided between the pressing member 30 and the holder TS. In this embodiment, the fixing nip N has a width of 3 mm and the gap G2 is 1.0 mm.

Figure 5:
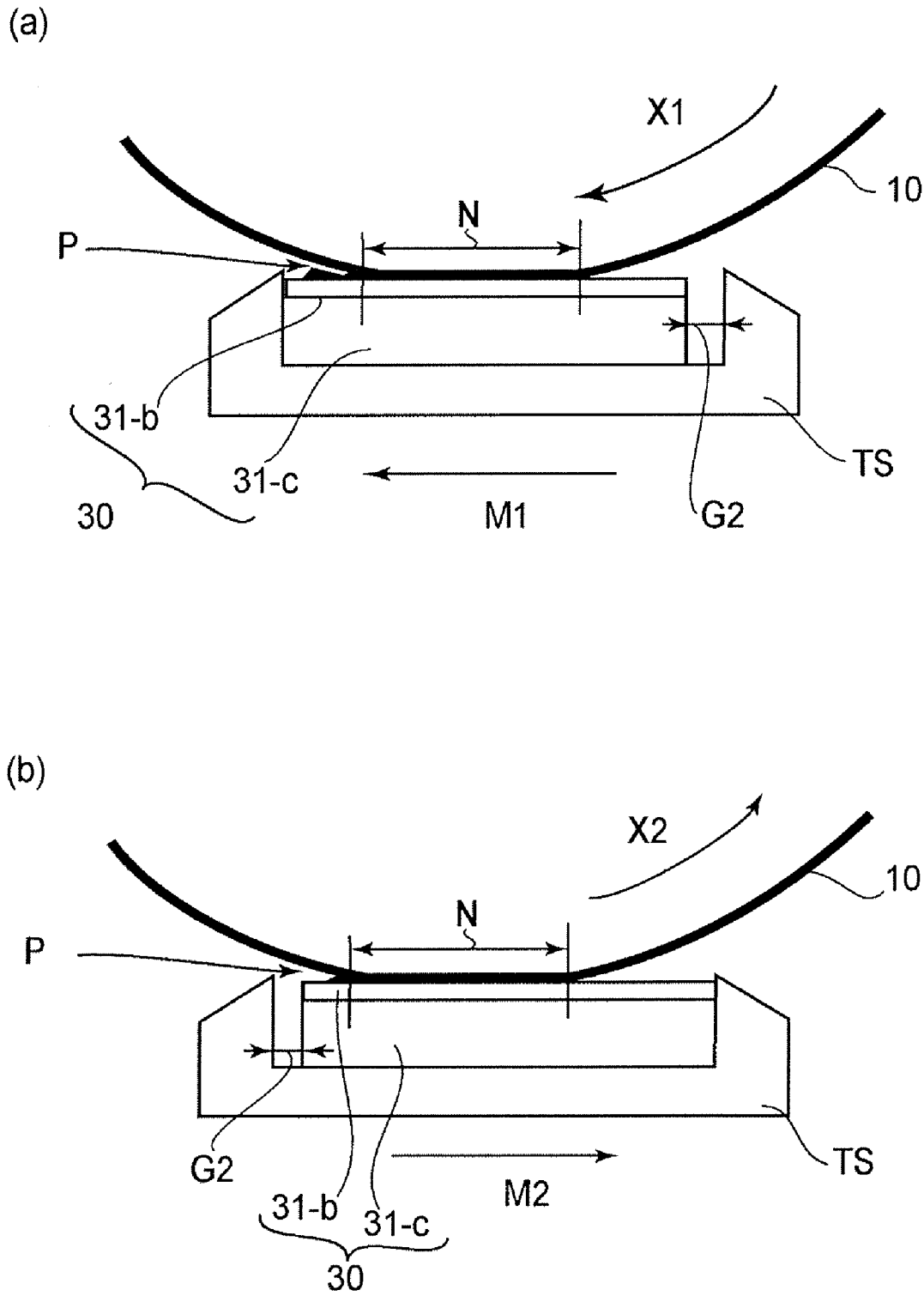
FIGS. 5(*a*) and 5(*b*) are schematic views showing positional relationships between a heating member and a fixing roller when the fixing roller is rotated normally (FIG. 5(*a*)) and reversely (FIG. 5(*b*)).

FIG. 5(*a*) is a schematic view showing a positional relationship between the pressing member 30 and the fixing roller 10 when the fixing roller 10 is normally rotated (X1 direction) and a positional relationship between the pressing member 30 and the holder TS. FIG. 5(*b*) is a schematic view showing a positional relationship between the pressing member 30 and the fixing roller 10 when the fixing roller 10 is reversely rotated (X2 direction) and a positional relationship between the pressing member 30 and the holder TS.

As shown in FIG. 3, the fixing unit motor MO2 is reversely rotated during the motor stop (after S4) after the premulti-rotation performed after turning-on of electric power and during the motor stop (after S10) after the post-rotation performed after completion of the printing (S41 and S42).

As shown in FIGS. 5(*a*) and 5(*b*), by reversely rotating the motor MO2, the pressing member 30 is moved from the position shown in FIG. 5(*a*) to the position shown in FIG. 5(*b*). An amount of this movement is equal to the value of the gap G2.

As shown in FIG. 5(*a*), an area P in which toner or paper dust is deposited is located on a downstream side of the pressing member 30 with respect to the rotational direction of the fixing roller 10. This toner is the residual toner which cannot be completely fixed on the recording material PA and deposited on the pressing member 30.

The area P is moved within the fixing nip N by the reverse rotation performed immediately after the motor stop (S41, S42), as shown in FIG. 5(*b*).

When the print is started in a state in which the pressing member is located at the position shown in FIG. 5(B), the toner deposited on the pressing member is removed by rubbing with the fixing roller 10. The thus removed toner deposited on the fixing roller 10 is transferred onto the upper surface of the recording material PA and fixed thereon.

By frequently performing the above described reverse rotation, an amount of the toner or paper dust deposited in the area P is very small, so that an image quality is not remarkably lowered even when the effect toner is deposited on the recording material PA. As a result, by performing the reverse rotation in this embodiment, it is possible to suppress an occurrence of jamming by suppressing accumulation of the toner or paper dust in the area P.

However, similarly as in the case of moving the heater 20, the above-described reverse rotation sequence is not always performed when the motor is stopped. In an emergency stop state such as jamming or the like, the reverse rotation sequence must not be performed. For example, in the emergency stop state, in the neighborhood of the fixing nip N, unfixed toner in a state in which both heat and pressure have not been applied is located in some cases. In such cases, when the reverse rotation sequence is performed, a large amount of the unfixed toner is deposited on the fixing roller surface and the pressing member surface, so that there is a possibility that the unfixed toner adversely affects the fixing roller 10 and the pressing member 30.

In the case of emergency stop such as jamming or the like, the electric power is turned on, i.e., the premulti-rotation is performed ordinarily after the jammed paper is removed. In this state, there is no recording material on which unfixed toner is carried in a large amount, so that the unfixed toner is not deposited on the fixing roller surface and the pressing member surface even when the reverse rotation is performed.

Here, a state after the reverse rotation sequence will be described. In this embodiment, by performing the reverse rotation sequence, the pressing member 30 is moved about 1.0 mm. However, by normally rotating the fixing roller after the reverse rotation sequence, the amount of movement is reset, so that the position of the pressing member 30 is returned to the ordinary position at which the pressing member 30 is located before the reverse rotation.

The change in position of the pressing member 30 by the normal rotation and the reverse rotation is due to its frictional force against the fixing roller 10.

In this embodiment, the non-rotatable pad-shaped pressing member 30 is used but the pressing member 30 may also be a rotatable roller. When the pressing member is the rotatable roller, a latitude for the contamination is basically increased.

Embodiment 2

Figure 6:
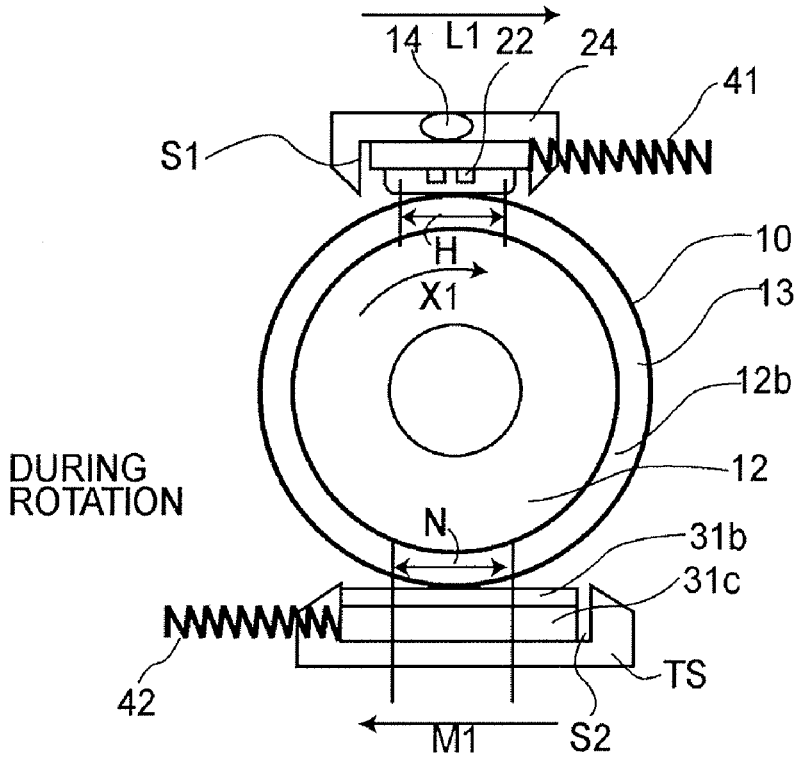
FIG. 6 is a constitutional view of an image heating apparatus in Embodiment 2, wherein a fixing roller is rotated normally.
Figure 7:
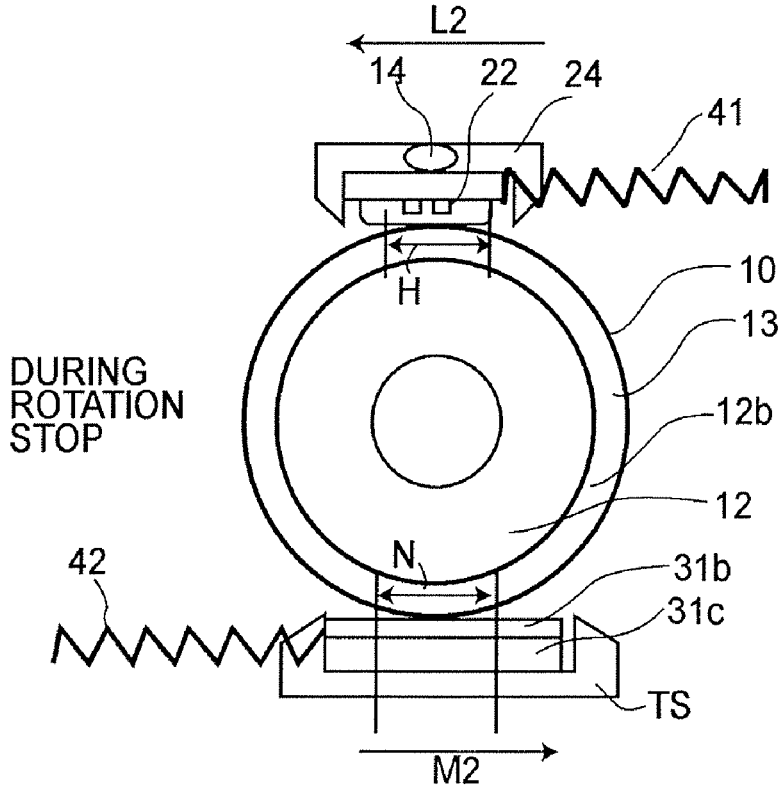
FIG. 7 is a constitutional view of an image heating apparatus in Embodiment 2, wherein the fixing roller is stopped.

An image heating apparatus of this embodiment will be described. FIG. 6 is a constitutional view showing the image heating apparatus of this embodiment in which a fixing roller 10 is placed in a rotating state. FIG. 7 is a constitutional view showing the image heating apparatus of this embodiment in which the fixing roller 10 is not rotated. Members or means identical to those employed in Embodiment 1 are represented by identical numerals or symbols and a redundant explanation will be omitted.

As shown in FIG. 6, in the image heating apparatus of this embodiment, springs (urging members) 41 and 42 for moving the heater 20 and the pressing member 30 are provided in place of the reverse rotation sequence employed in Embodiment 1. As a result, without reversely/rotating the fixing unit motor, it is possible to suppress the deposition of the toner in the heater 20 and the pressing member 30 with an inexpensive constitution. A driving mechanism for moving the heating member (heater) to a first position (FIG. 6) and a second position (FIG. 7) includes the fixing roller 10 for moving the heating member to the first position and the urging member for moving the heating member to the second position. Although described specifically later, the heating member in this embodiment is moved to the first position against an urging force of the urging member by receiving a force from the fixing roller by rotation of the fixing roller and moved to the second position by the urging force when the rotation of the fixing roller is stopped.

In a specific constitution, similarly as in Embodiment 1, a gap is provided between the heater 20 and the heating member holder 24 for holding the heater 20. The gap is 1.0 mm. On the other hand, a gap is also provided between the pressing member 30 and the holder TS for holding the pressing member 30. The gap is also 1.0 mm. When the fixing roller 10 is rotated, the heater 20 and the pressing member 30 overcome the urging forces of the springs 41 and 42 to be moved to the position shown in FIG. 6, so that a gap (spacing) S1 (=1 mm) and a gap S2 (=1 mm) are created at upstream-side portions with respect to the rotational direction of the fixing roller 10.

The spring 41 urges the heater 20 toward the upstream portion with respect to the rotational direction of the fixing roller 10. The spring 41 is compressed by the movement of the heater 20 when the fixing roller 10 is rotated. In this embodiment, a pressing force from the heater 20 to the fixing roller 10 is 2.0 kgf (19.6 N), so that a load of about 2.0 kgf (19.6 N) is applied to the spring 41 by a frictional force between the fixing roller 10 and the heater 20.

The spring 42 urges the pressing member 30 toward the upstream portion with respect to the rotational direction of the fixing roller 10. The spring 42 is compressed by the movement of the pressing member 30 when the fixing roller 10 is rotated. In this embodiment, a pressing force from the pressing member 30 to the fixing roller 10 is 2.0 kgf (19.6 N), so that a load of about 1.5 kgf (14.7 N) is applied to the spring 41 by a frictional force between the fixing roller 10 and the pressing member 30.

As shown in FIG. 7, in the case where the fixing roller 10 is stopped, there is no frictional force received from the fixing roller 10. In addition, compression forces of the springs 41 and 42 are released, whereby the heater 20 and the pressing member 30 are moved in a direction of increasing the gap on the downstream side with respect to the rotational direction of the fixing roller 10 to be returned to the states before the rotation of the fixing roller 10 (returned from the state of FIG. 6 to the state of FIG. 7).

In this embodiment, similarly as in Embodiment 1, a fixing roller contact area of the heater 20 and a fixing roller contact area of the pressing member 30 are different between during rotation of the fixing roller 10 and during stop of the fixing roller 10. For this reason, toner or paper dust deposited on the heater 20 and the pressing member 30 can be deposited on the fixing roller 10, thus being discharged after being transferred onto the recording material PA. As a result, it is possible to suppress an occurrence of an offset image and image failure caused due to damage and wearing of the roller and falling of the deposited toner.

Further, it is also possible to suppress an amount of the toner deposited on the heater and the pressing member, so that it is possible to prevent shortening of lifetime due to a lowering in driving torque and wearing. In this embodiment, in addition to the effects achieved in Embodiment 1, it is not necessary to perform the reverse rotation sequence, so that a throughput can be improved.

In this embodiment, the spring 41 has a force of 1.8 kgf (17.6 N) and the spring 42 has a force of 1.4 kgf (13.7 N). These forces may be changed since a constitutional state of the image heating apparatus varies largely depending on the pressing forces and the materials of the coating and the sheet.

Next, embodiments in which the heating member is moved from the first position to the second position during the toner image heating to suppress deposition of the toner on the heating member will be described.

Embodiment 3

In this embodiment, first, a constitution of a main assembly of an image forming apparatus to which an image heating apparatus of the present invention is mounted will be described and then a fixing apparatus to which the image heating apparatus is applied will be described.

[Main Assembly Constitution]

In this embodiment, ordinary method and apparatus for forming an unfixed toner image on the recording material are employed and will be described with reference to FIG. 28.

Figure 28:
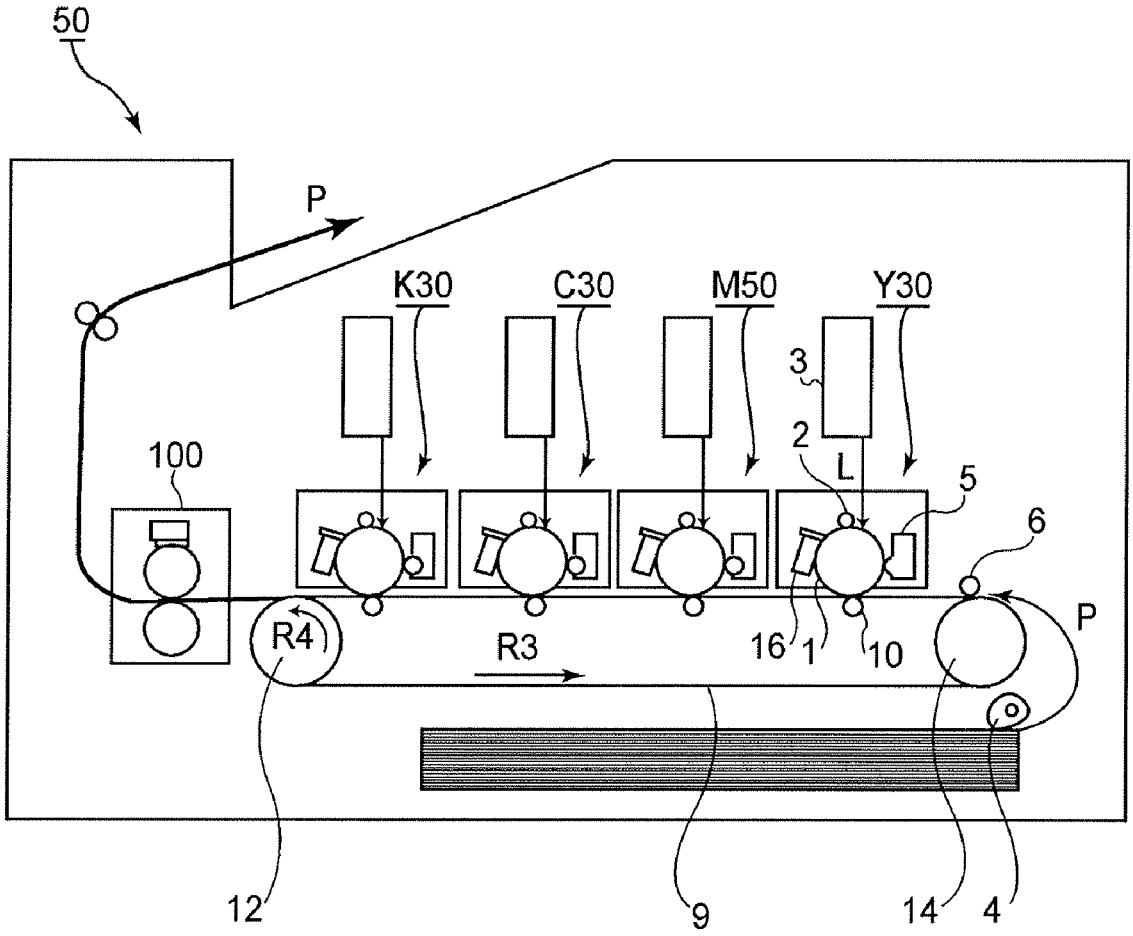
FIG. 28 is a sectional view of an image forming apparatus in which an image heating apparatus is mounted as a fixing apparatus.

Referring to FIG. 28, an image forming apparatus 50 in this embodiment employs a method in which toner images of four colors of yellow, magenta, cyan, and black are successively transferred onto a recording material P carried on a recording material conveying belt 9 to form one image. Around a peripheral surface of a photosensitive drum 1, a charger 2, an exposure device 3 for irradiating the photosensitive drum 1 with laser light, a developing device 5, a transfer roller disposed via the recording material conveying belt, and a photosensitive drum cleaner 16 are disposed in this order with respect to a rotational direction indicated by an arrow R1. First, a surface of the photosensitive drum 1 is electrically charged to a negative polarity by the charger 2. On the surface of the charged photosensitive drum 1, an electrostatic latent image is formed by exposure to light L by the exposure device 3 since the exposed portion is increased in surface potential. At the electrostatic latent image portion on the photosensitive drum 1, toner is deposited by the developing device 5 containing first yellow toner to form a yellow toner image.

The recording material conveying belt 9 is supported by two supporting shafts (a driving roller 12 and a tension roller 14) and rotated in a direction indicated by an arrow R3 by the driving roller 12 rotating in a direction indicated by an arrow R4. The recording material P is electrically charged by an adsorption roller 6 to which a positive-polarity bias is applied when the recording material P is fed by a sheet feeding roller 4, and is electrostatically adsorbed and conveyed on the recording material conveying belt 9. When the recording material P is conveyed to a transfer nip N1, a positive-polarity transfer bias is applied from an unshown power source to the transfer roller 10 rotated by the recording material conveying belt 9, so that the yellow toner image on the photosensitive drum 1 is transferred onto the recording material P in the transfer nip N1. From the surface of the photosensitive drum 1 after the transfer, transfer residual toner is removed by the photosensitive drum cleaner 16 having an elastic blade.

A series of image forming processes including the above described charging, exposure, developing, transfer, and cleaning is successively performed with respect to respective developing cartridges M30 for second color of magenta, C30 for third color of cyan, and K30 for fourth color of black to form four color toner images in total on the recording material P carried on the recording material conveying belt 9. The recording material P carrying thereon the four color toner images are conveyed to a fixing apparatus 100, in which fixation of the surface toner images is effected.

[Fixing Apparatus]

Figure 10:
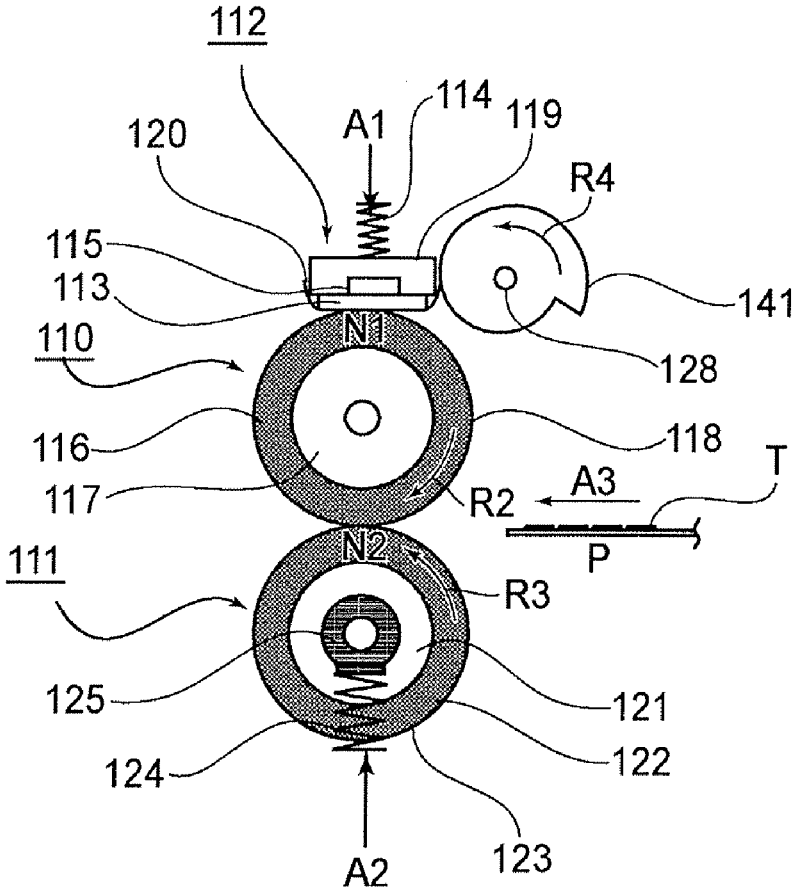
FIG. 10 is a constitutional view of an image heating apparatus in Embodiment 3.

The fixing apparatus 100 in this embodiment will be described. The fixing apparatus 100 in this embodiment in a surface image heating apparatus of a sliding contact type for reducing a rise time and electric power consumption. FIG. 10 is a schematic sectional view showing the fixing apparatus in this embodiment. In contact with an outer peripheral surface of a fixing roller (rotatable member) 110, a heater 112 as a heating unit (heating member) is disposed to form a contact heating portion (heating area) N1. On the other hand, a pressing roller 111 contacts the fixing roller 110 to form a fixing nip N2.

The fixing roller 110 has an outer diameter of 20 mm and is prepared by forming a 4 mm-thick elastic layer 116 (foamed silicone rubber layer) on an outer surface of an iron-made core metal 117 having a diameter of 12 mm. When the fixing roller 110 has a large thermal capacity and a large thermal conductivity, the fixing roller 110 is liable to absorb therein heat received through the outer peripheral surface thereof, thus being less increased in surface temperature. In other words, it is possible to reduce a rise time of the surface temperature of the fixing roller 110 when the fixing roller 110 has thermal capacity and conductivity as low as possible and is formed of a material having a high heat insulating effect. The foamed silicone rubber has a thermal conductivity of 0.11-0.16 W/m·K lower than that (0.25-0.29 W/m·K) of a solid rubber. With respect to a specific gravity associated with the thermal capacity, the solid rubber has a specific gravity of about 1.05-1.30, whereas the foamed silicone rubber has a specific gravity of about 0.75-0.85, thus having a low thermal capacity. Accordingly, this foamed silicone rubber is capable of shortening the rise time of the surface temperature of the fixing roller 110. A small outer diameter of the fixing roller 110 is effective in suppressing the thermal capacity but an excessively small outer diameter leads to a small width of the contact heating portion N1, so that the fixing roller 110 requires a proper outer diameter and thus has an outer diameter of 20 mm in this embodiment. Also with respect to a thickness of the elastic layer 116, a proper thickness is required since an excessively thin elastic layer leads to dissipation of heat into the iron-made core metal and thus is 4 mm in this embodiment. On the elastic layer 116, as a parting (release) layer of toner, a parting layer 118 formed of perfluoroalkoxy (PFA) resin is disposed. The parting layer 118 may be prepared by coating the elastic layer 116 with a tube or paint. In this embodiment, the tube excellent in surface durability is employed. In addition to PFA, as the material for the parting layer 118, it is also possible to use a fluorine-containing resin material such as polytetrafluoroethylene (PTFE) resin or tetrafluoroethylene-hexafluoropropylene (FEP) resin; fluorine-containing rubber and silicone rubber excellent in parting property; and the like. A surface hardness of the fixing roller 110 can ensure a width of the contact heating portion N1 even at a low pressure when it is small but an excessively small surface hardness impairs surface durability. For this reason, in this embodiment, the fixing roller has a surface hardness of 40-45 degrees in terms of Asker-C hardness (under a load of 4.9 N). The fixing roller 110 is rotated in a direction indicated by an arrow R2 at a surface moving speed of 60 mm/sec by an unshown rotating means.

The pressing roller 111 may preferably have a low thermal capacity and a low thermal conductivity so as not to draw heat from the fixing roller 110 and has the same constitution as that in Embodiment 1. The pressing roller 111 has an outer diameter of 20 mm and is prepared by forming a 4 mm-thick foamed rubber elastic layer 122 on an outer surface of an iron-made core metal 121 having a diameter of 12 mm. The pressing roller 111 has a parting layer 123 formed of PFA as an outermost layer. The pressing roller 111 is pressed against the fixing roller 110 at a force of 147N in a direction indicated by an arrow A1 by a pressing roller pressing spring 124 via a bearing 125 to form the fixing N2 having a width of 7 mm and is rotated in a direction indicated by an arrow A3 by the fixing roller 110.

The heating unit 112 is constituted by a heater (heating element) 113 as a heating source, a heater holder 119 for holding the heater 113, and a heat sliding layer 120 contacting the heater 113. The heating unit 112 is pressed against the fixing roller 110 at a force of 117.6N in a direction indicated by an arrow A1 by a pressing spring 114 to form the contact heating portion N1 having a width of 8 mm with respect to the fixing roller rotational direction. The heater 113 includes an alumina substrate, a heat generating resistor layer formed on the substrate, and a protective layer. The substrate has a width of o12 mm with respect to the fixing roller rotational direction and a thickness of 1 mm. The heat generating resistor layer is formed of silver-palladium (Ag/Pd) in a size of 4 mm in width and 10 μm in thickness at a central portion of the substrate by screen printing. The protective layer is formed of glass in a thickness of 50 μm. The surface of the fixing roller 110 may be heated by causing the glass surface of the heater 113 to directly contact the surface of the fixing roller 110 but in this embodiment, the heat sliding layer excellent in parting property and slidability is provided on the surface of the heater 113. This heat sliding layer 120 not only suppresses deposition of the offset toner from the surface of the fixing roller 110 to the heating unit 112 but also reduces a frictional force by rubbing with the fixing roller 110. As a material for the heat sliding layer 120, it is possible to use a fluorine-containing resin such as PFA excellent in parting property with respect to toner or PTFE excellent in slidability. An excessively thick heat sliding layer 120 is less liable to transfer heat from the heater 113 to the fixing roller 110 and an excessively thin heat sliding layer 120 has a poor surface durability, so that the thickness of the heat sliding layer 120 may preferably be about 1-100 μm. Further, the heat sliding layer 120 may preferably have a sheet shape excellent in durability and surface property. In the case of the sheet shape, the heat sliding layer 120 can be disposed to cover upstream and downstream edge portions of the heater 113, so that the fixing roller 110 is advantageously protected from damage by the edges of the heater 113. In this embodiment, as the heat sliding layer 120, a 50 μm-thick PFA sheet is used and disposed to cover the edges of the heater 113. At a rear surface of the heater 113, a temperature detecting device 115 for detecting a rear surface temperature of the ceramic substrate increased in temperature depending on heat generation of energized heat generating resistor layer is disposed. The temperature of the heater 113 is adjusted by appropriately controlling a current flowing from an unshown electrode portion disposed at a longitudinal end portion of the heater 113 to the energized heat generating resistor layer depending on a signal from the temperature detecting device 115. The heater 113 heats the surface of the fixing roller 110 in an area of the contact heating portion N1.

When the recording material P onto which the unfixed toner image T is transferred is conveyed to the fixing nip N2 by an unshown conveying means, heat at the surface of the fixing roller 110 is transferred to the unfixed toner image and the recording material P to fix the toner image T on the recording material P.

Figure 11:
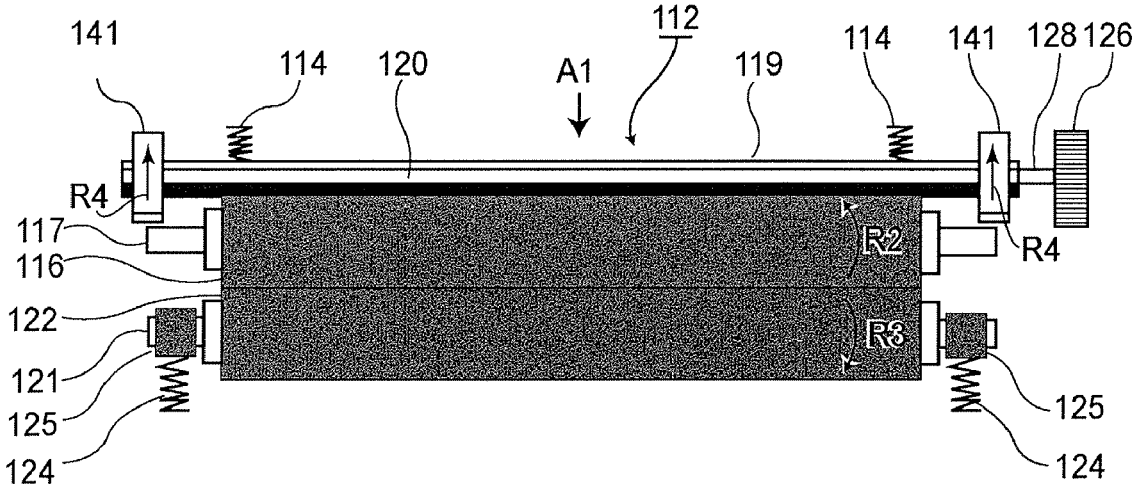
FIG. 11 is a front view of the image heating apparatus in Embodiment 3.

Next, a constitution, as a feature of the present invention, in which the heating unit is moved will be described. In the sliding contact type surface image heating apparatus in this embodiment, the heating member is moved in a direction opposite from the fixing roller rotational direction at the contact heating portion. The fixing apparatus in this embodiment is provided with a heat element swingable cam 141 for moving the heating unit 112 (the heater 113) in an opposite direction from the fixing roller rotational direction. A front view of the fixing apparatus as seen from a direction indicated by an arrow A3 in FIG. 10 is shown in FIG. 11. The cam 141 is provided about a cam shaft 128 at both longitudinal end portions of the heating unit 112. A cam rotation gear 126 provided at an end portion of the cam shaft 128 is rotationally driven by an unshown driving means to rotate the came 141 in a direction indicated by an arrow R4.

Figure 12:
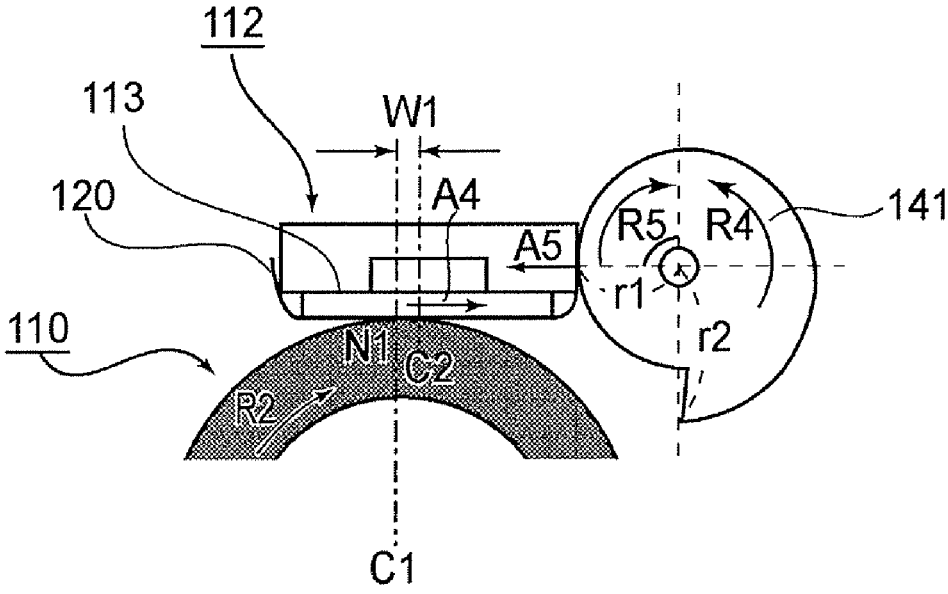
FIG. 12 is a schematic view showing a heating member driving mechanism of the image heating apparatus in Embodiment 3.
Figure 13:
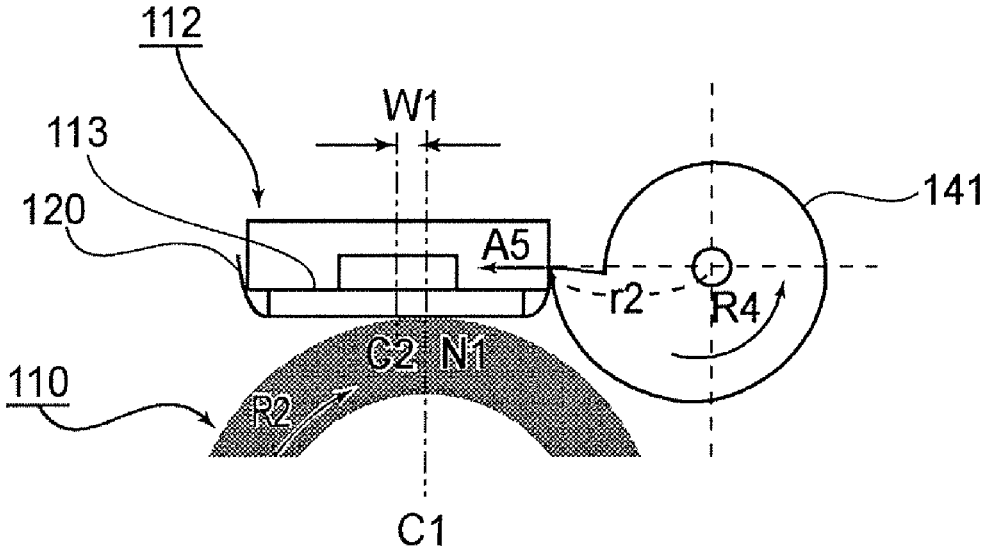
FIG. 13 is a schematic view showing a state in which a heating member is moved in a direction opposite from a rotational direction of a fixing roller in Embodiment 3.

FIG. 12 is an enlarged view of the contact heating portion and its neighborhood. When the fixing roller 110 is rotated in the arrow R2 direction, the heating unit 112 receives a force in a direction of an arrow A4 (the same direction as the fixing roller rotational direction) by friction with the fixing roller 110 at the contact heating portion N1. The heat unit 112 in this embodiment is movable in directions identical to and opposite from the fixing roller rotational direction. For this reason, when the fixing roller 110 is rotated in the arrow R2 direction to apply the force to the heating unit 112 in the arrow A4 direction, the heating unit 112 is placed in a contact state with the cam 141. In this state, a center line C2 of the heating unit (the substrate of the heater) is located at a position (first position) moved from a center line C1 of the fixing roller 110 by W1=2 mm. The cam 141 has a larger radius with an increasing degree of phase shift in an arrow R5 direction. For this reason, when the cam 141 is rotated in an arrow R4, the heat unit 112 is pushed and moved in a direction opposite from the surface moving direction A4 thereof (the fixing roller rotational direction) at the contact heating portion N1. The cam 141 in this embodiment has such a shape that the radius is smoothly increased from minimum radius R1=10 mm to a maximum radius R2=14 mm by 4 mm during rotation up to ¾ turn (270 degrees). The cam 141 pushes and moves the heating unit 112 by 4 mm in the opposite direction from the fixing roller rotation direction by being rotated, in the arrow R4 direction by 270 degrees, from the position of the minimum radius (R1=10 mm) shown in FIG. 12 to the maximum radius (R2=14 mm) shown in FIG. 13 at the contact portion with the heating unit 112. As shown in FIG. 13, when the heating unit 112 is moved from the position shown in FIG. 12 by 4 mm in the opposite direction from the fixing roller rotational direction, the center line C2 of the heating unit 112 is located at a position (second position) moved in the opposite direction from the fixing roller rotational direction with a distance W2=2 mm from the center line C1 of the fixing roller 110.

Figure 14:
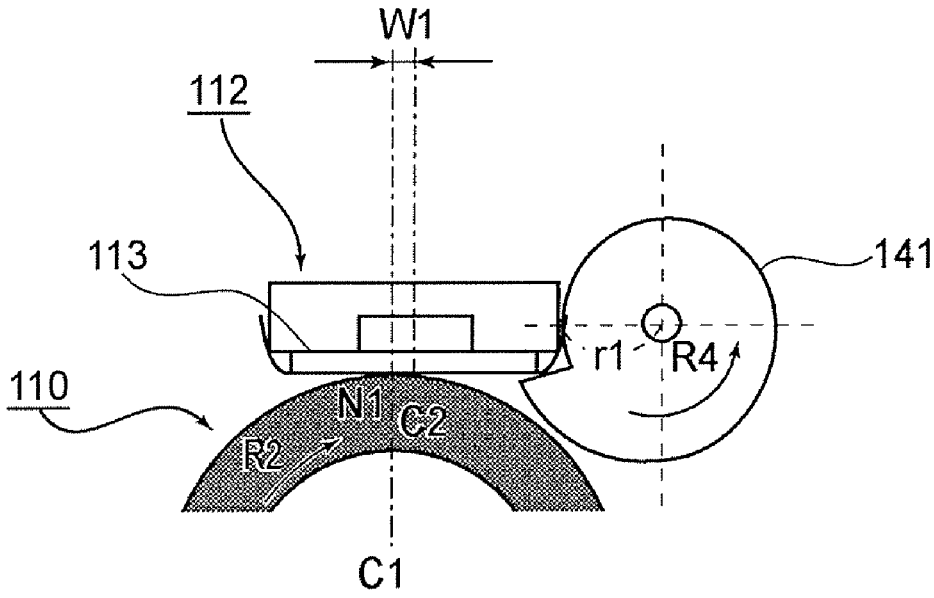
FIG. 14 is a schematic view showing a state in which the heating member is moved in the same direction as the rotational direction of the fixing roller in Embodiment 3.

When the cam 141 is further rotated and located at a position shown in FIG. 14, a radius of the cam 141 at the contact portion with the heating unit 112 is again the minimum radius R1=10 mm. For this reason, the heating unit 112 is moved in the identical direction to the fixing roller rotational direction while contacting the cam 141 to be returned to the position shown in FIG. 12.

More specifically, in the case where the fixing roller 110 is rotated in the arrow R2 direction, when the cam 141 is rotated in the arrow R4 direction, the heating unit 112 is moved to the position shown in FIG. 13 and then returned to the position shown in FIG. 12 through the position shown in FIG. 13, thus being reciprocated. As described above, the driving mechanism in this embodiment includes the cam (member) 141 for urging the heating member from the first position to the second position, and the heating member is moved to the first position and the second position depending on the motions of the fixing roller 110 and the cam 141.

Figure 15:
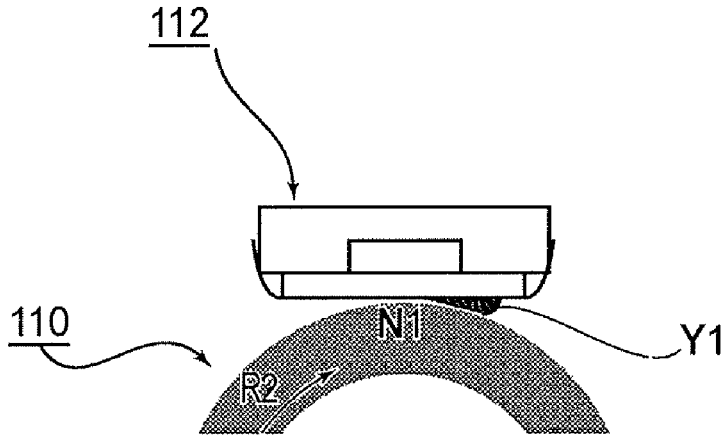
FIG. 15 is a schematic view showing a deposition state of toner leading to toner contamination in an image heating apparatus to which a heating member is fixed.

On the other hand, in a constitution in which a heating unit is fixed so as not to be moved, when continuous printing is performed, a contaminant such as paper dust or offset toner is accumulated on the heating unit 112 side at the contact heating portion N1 as described above. FIG. 15 is a schematic view for illustrating a state of the contaminant accumulated at the contact heating portion N1 in the constitution in which the heating unit is not moved. Referring to FIG. 15, a contaminant Y1 remaining at the contact heating portion N1 contains paper dust and offset toner in mixture, so that it is placed in a melted state by being rubbed with the fixing roller 110 at the contact heating portion N1. In this melted state, the contaminant Y1 passes through the contact heating portion N1 to be accumulated in a deposition state on the heating unit side located downstream from the contact heating portion N1 (close to an outlet portion of the contact heating portion N1). When the continuous printing is further continued, the downstream contaminant Y1 of the contact heating portion N1 is further deposited to increase a contact area between the fixing roller 110 and the contaminant Y1. In this state, a large amount of the contaminant is transferred from the heat unit 112 to the fixing roller 110, so that a recording material subsequently conveyed can be contaminated. Further, in some cases, the contaminant Y1 located downstream from the contact heating portion N1 is still accumulated continuously without being transferred onto the fixing roller 110 to enter the contact heating portion N1, so that heat conduction from the heater 113 to the fixing roller 110 can be impaired to cause image failure such as fixation failure.

Figure 16:
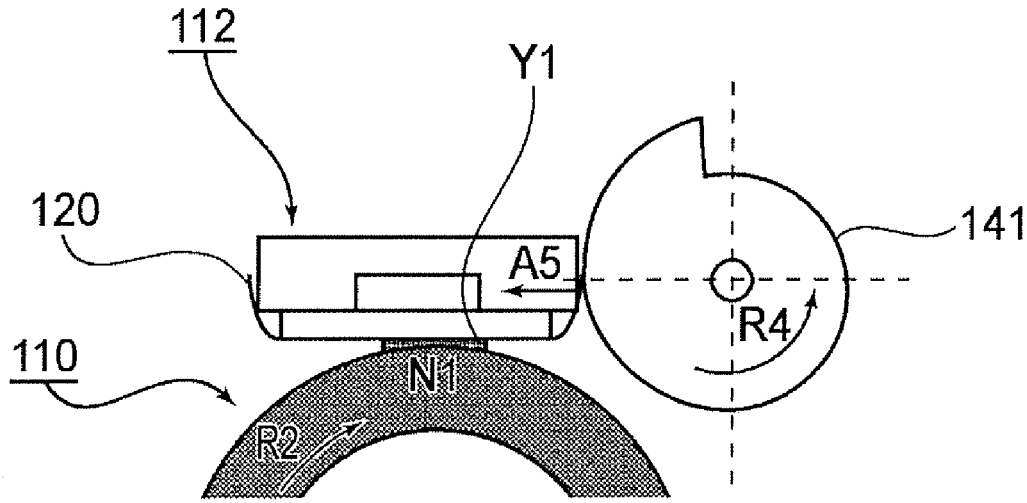
FIG. 16 is a schematic view showing a state in which a contaminant located downstream from a contact heating portion is moved in the contact heating portion.
Figure 17:
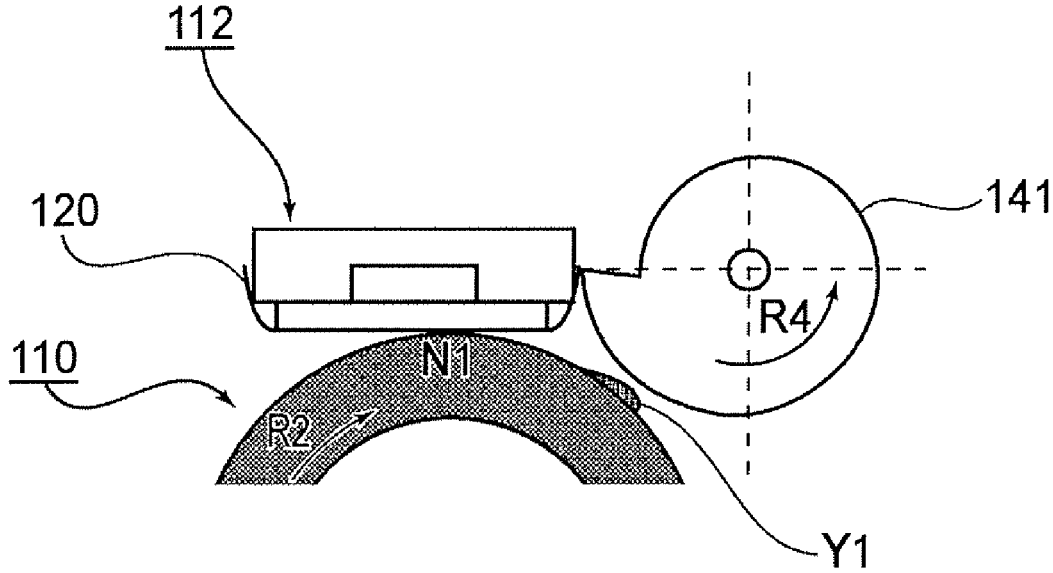
FIG. 17 is a schematic view showing a state in which the contaminant moved in the contact heating portion is transferred onto the fixing roller.

In this embodiment, as described above, the heating unit 112 is moved in the opposite direction from the fixing roller rotational direction. In the case where the contaminant Y1 is accumulated at a portion downstream from the contact heating portion N1, when the cam 141 is rotated to move the heating unit 112 in the opposite direction from the fixing roller rotational direction, the contaminant Y1 enters the contact heating portion N1 as shown in FIG. 16. At the contact heating portion N1, the surface of the fixing roller 110 is moved in a direction opposite from the arrow A5 direction in which the heating unit 112 is moved. For this reason, the contaminant Y1 entering the contact heating portion N1 is removed by rubbing with the fixing roller 110, so that it is possible to transfer the contaminant Y1 onto the surface of the fixing roller 110 as shown in FIG. 17. The contaminant Y1 transferred onto the fixing roller 110 is transferred onto the pressing roller 111, which has a lower temperature than that of the fixing roller 110, when it reaches the fixing nip N2. Thereafter, when the recording material P is conveyed to the fixing nip N2, the contaminant Y1 on the pressing roller 111 is deposited on a rear (back) surface of the recording material P to be discharged. Further, it is also possible to deposit the contaminant Y1 on the front (image forming) surface of the recording material P by moving the heating unit 112 in the opposite direction from the fixing roller rotational direction to transfer the contaminant Y1 onto the surface of the fixing roller 110 when the recording material P passes through the fixing nip N2. As described above, by moving the heating unit 112 in the opposite direction from the fixing roller rotational direction, the contaminant Y1 located downstream from the contact heating portion N1 can be transferred onto the fixing roller 110, so that it is possible to discharge the contaminant Y1 onto the recording material P at the fixing nip N2.

The removal of the contaminant Y1 by moving the heating unit 112 in the opposite direction from the fixing roller rotational direction is performed on the recording material P, so that the removal of the contaminant Y1 may preferably be performed frequently so that the contaminant Y1 deposited on the recording material P can be unnoticeable. In this embodiment, during passage of the recording material P through the fixing nip N2, the heating unit 112 is always moved in the opposite direction from the fixing roller rotational direction so as not to accumulate the contaminant Y1 at the downstream portion from the contact heating portion N1.

Figure 18:
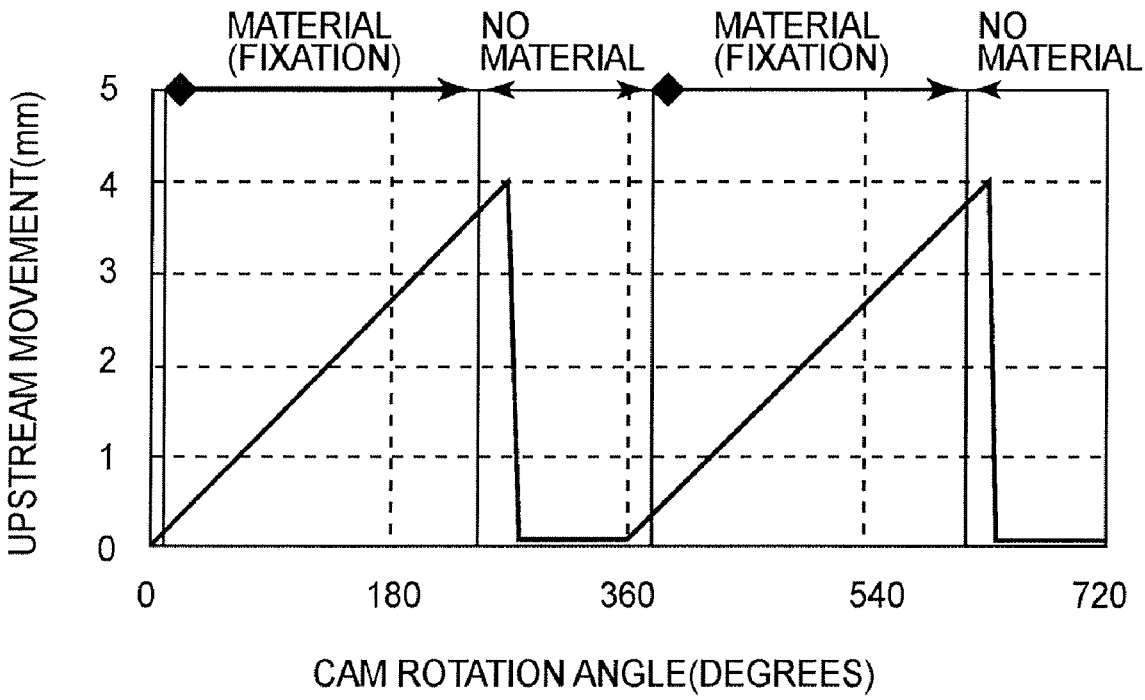
FIG. 18 is a graph showing a relationship between a conveying timing of a recording material and a reciprocating timing of a heating member.

Timing of movement of the heating unit 112 in the opposite direction from the fixing roller rotational direction and timing of conveyance of the recording material P in this embodiment are shown in FIG. 18. In FIG. 18, a rotation angle (degrees) of the cam 141 is taken as an abscissa and an amount of movement of the heating unit toward an upstream portion by the rotation of the cam is taken as an ordinate. The position of heating unit 112 at cam rotation angles of 0 and 360 degrees is as shown in FIG. 12 and at this position, the upstream movement amount (ordinate) is taken as 0 mm. When the cam 141 is rotated and the heating unit 112 is started to move toward the upstream portion, the recording material P is conveyed to the fixing nip N2 to start fixation of the toner image on the recording material P. When the recording material P passes through the fixing nip N2, the cam 141 is constituted so as to be rotated in synchronism with the conveyance of the recording material P so that the heating unit 112 is moved to the upstream portion. When the passage of the recording material P through the fixing nip N2 is completed, the upstream movement (4 mm) of the heating unit 112 is completed. During a period until a subsequent recording material P is conveyed to the fixing nip N2, the cam 141 is rotated at timing such that the heating unit 112 is returned to the original (downstream) portion. In this embodiment, the conveyance of the recording material P and the rotation of the cam 141 are synchronized, so that the heating unit 112 is always moved in the opposite direction from the fixing roller rotational direction during the period in which the recording material P passes through the fixing nip N2. In other words, the movement direction of the heating unit 112 during a period for heating a single sheet of recording material is only the opposite direction from the fixing roller rotational direction. Accordingly, the contaminant such as paper dust or offset toner reaching the contact heating portion N1 is always removed by rubbing with the fixing roller 110, so that the contaminant cannot be accumulated at a portion downstream from the contact heating portion N1. Further, the contaminant can be discharged onto the recording material P little by little from a leading end to a trailing end of the recording material P, thus being efficiently discharged on the recording material P without becoming noticeable.

When the heating unit 112 is moved by about 1 mm or more in the opposite direction from the fixing roller rotational direction, the contaminant located downstream from the contact heating portion N1 can be transferred onto the fixing roller 110. A larger amount of the movement leads to a longer rubbing removal time of the contaminant at the contact heating portion N1 by the fixing roller 110, so that a contaminant removing effect becomes larger. However, when the energized heat generating resistor layer of the heater 113 comes out of the area of the contact heating portion N1 by moving the heating unit 112 in the opposite direction from the fixing roller rotational direction, the surface temperature of the fixing roller 110 is lowered. In the case where the heating unit 112 is moved in the opposite direction from the fixing roller rotational direction when the toner image is fixed on the recording material P as in this embodiment, the energized heat generating resistor layer is required not to come out of the area of the contact heating portion N1. In this embodiment, in order that the energized heat generating resistor layer having a width of 4 mm does not come out of the contact heating portion N1 having a width of 8 mm even when the heating unit 112 is moved, an amount of movement of the heating unit 121 is set to 4 mm.

As described above, in the constitution of this embodiment, the heating unit 112 is always moved in the opposite direction from the fixing roller rotational direction during the passage of the recording material P through the fixing nip N2, the contaminant located downstream from the contact heating portion N1 can be discharged unnoticeably onto the recording material P. As a result, it is possible to suppress the deposition of the contaminant at a portion downstream from the contact heating portion N1.

Comparison between the constitution in which the heating unit is moved in the opposite direction from the fixing roller rotational direction as in this embodiment and the constitution (Comparative Embodiment) in which the heating unit is fixed so as not to moved is made by performing a continuous printing test. In the continuous printing test, an image having a print ratio of 5% is continuously printed up to $10\times10^4$ sheets (lifetime of the image forming apparatus) and the presence or absence of occurrence of image failure or fixation failure due to the contaminant accumulated at the contact heating portion is checked. In the constitution of Comparative Embodiment, at the time of printing on about 500 sheets, a large amount of the contaminant deposited at the contact heating portion was discharged on the fixing roller to cause image failure. The image failure successively occurred at a rate of one sheet per about 200 sheets-printing after the printing on 500 sheets and one sheet per about 100 sheets-printing after the printing on about 40,000 sheets. Further, after the printing on about 80,000 sheets, fixation failure due to heat conduction inhibition by the deposition of the contaminant at the contact heating portion was started to occur. On the other hand, in the constitution of this embodiment, the heating unit is always moved in the opposite direction from the fixing roller rotation direction during the passage of the recording material through the fixing nip, so that the contaminant reaching the contact heating portion is always removed by the fixing roller, thus being not accumulated at the contact heating portion in a large amount. As a result, up to $10\times10^4$ sheet which is the lifetime the image forming apparatus, image failure and fixation failure due to the contamination of the contact heating portion did not occur.

In the above described constitution, the timing of conveyance of the recording material P and the timing of movement of the heating unit 112 are synchronized so that the heating unit 112 is always moved in the opposite direction from the fixing roller rotation direction during the passage of the recording material P through the fixing nip N2. However, the timing of moving the heating unit 112 and a speed thereof are not limited to those described above. When the fixing roller 110 is rotated, it is possible to transfer the contaminant at the contact heating portion N1 onto the fixing roller 110 by moving the heating unit 112 in the opposite direction from the fixing roller rotational direction. For example, when the recording material P is not caused to pass through the fixing nip N2, the fixing roller 110 is rotated and the heating unit 112 may be moved in the opposite direction from the fixing roller rotational direction. By transferring the contaminant at the contact heating portion N1 onto the fixing roller 110 when the recording material P does not pass through the fixing nip N2, the contaminant can be transferred from the fixing roller 110 onto the pressing roller 111 to be discharged on the back surface of the recording material P. By frequently removing the contaminant in such a manner that the heating unit 112 is moved every fixing the toner image on one sheet of the recording material P, the contaminant can be unnoticeably discharged on the back surface of the recording material P. Further, the fixing process is not performed when the recording material P does not pass through the fixing nip N2, so that there is no problem even when the temperature of the fixing roller 110 is lowered to the extent that the fixation of the toner image on a subsequent recording material P can be ensured. For this reason, the movement distance of the heating unit 112 can be increased with an increasing distance of the energized heat generating resistor layer of the heater 113 from the contact heating portion N1, so that a contaminant removing ability can be improved. When the movement distance of the heating unit 112 toward the upstream portion is large, a time (distance) for removing the downstream-side contaminant at the contact heating portion N1 by the fixing roller 110 is increased, so that it is possible to reliably remove the contaminant located downstream from the contact heating portion N1.

The frequency of movement of the heating unit 112 in the opposite direction from the fixing roller rotational direction is not limited to every printing on one sheet but may also be decreased within the range of acceptable amount of the contaminant discharged on the recording material P. Further, the heating unit may be reciprocated plural times in the fixing roller rotational direction and the opposite direction thereof during the fixing process of one sheet of the recording material. That is, the heating member can be reciprocated between the first position and the second position during the toner image heating.

The method of moving the heating unit 112 is also not limited to the above described method using the cam. Similar function and effect can be achieved so long as the heating unit 112 is moved in the opposite direction from the fixing roller rotational direction when the fixing roller 110 is rotated.

Embodiment 4

In this embodiment, an image forming apparatus for forming an unfixed toner image is an ordinary image forming apparatus similarly as in Embodiment 3 and accordingly will not be described in detail. Further, also with respect to the sliding contact type surface image heating apparatus, members or means identical to those in Embodiment 3 are represented by identical reference numerals or symbols and omitted from explanation. A constitution of this embodiment is characterized in that a heating element is rotationally moved in a direction opposite from the fixing roller rotational direction at the contact heating portion.

Figure 19:
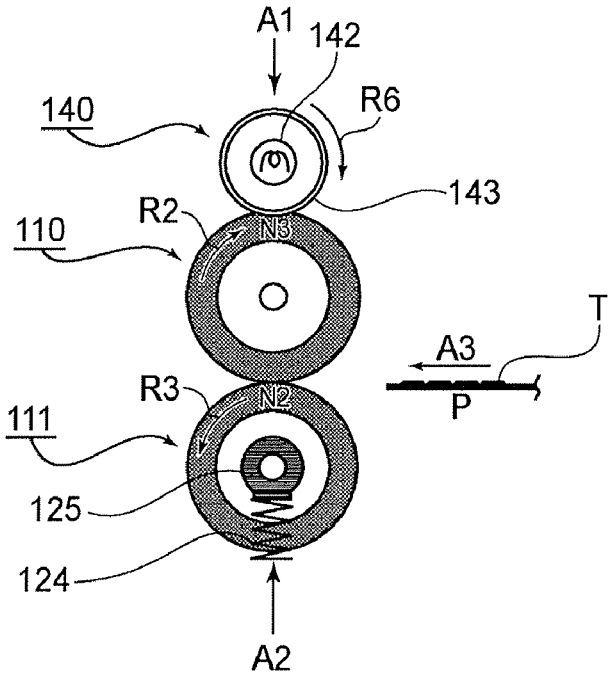
FIG. 19 is a constitutional view of an image heating apparatus in Embodiment 4.

FIG. 19 is a schematic view of a sliding contact type surface image heating apparatus in this embodiment. The fixing roller 110 and the pressing roller 111 are constituted similarly as in Embodiment 3, so that the pressing roller 111 is rotated in the arrow R3 direction by the rotation of the fixing roller 110 in the arrow R2 direction. A heating element 140 for heating the fixing roller 110 contacts an outer peripheral surface of the fixing roller 110 to form a contact heating portion N3.

The heating element 140 in this embodiment is constituted by a heat roller including an aluminum pipe 143 in which a halogen heater is contained. On an inner surface of the aluminum pipe 143, a heat insulating absorbing paint which is liable absorb radiation from the halogen heater is coated, so that radiant heat is transferred to the aluminum pipe 143. On an outer surface of the aluminum pipe 143, a parting layer of PFA is formed so that paper dust or offset toner coming from the fixing roller 110 is less liable to deposit on the aluminum pipe 143. A thinner parting layer is more liable to transfer heat from the halogen heater to the outer peripheral surface of the fixing roller 110. In this embodiment, the PFA parting layer is formed in a thickness of 10 μm by coating. As a material for the parting layer 118, in addition to PFA, a fluorine-containing resin material such as PTFE or FEP may be used but in this embodiment, PFA excellent in heat resistivity and releasability is used. The aluminum pipe 143 can decrease its thermal capacity when it has a small outer diameter and a small thickness, so that heat is move liable to be quickly transferred to the fixing roller outer surface. However, excessively small outer diameter and thickness lead to a small (mechanical) strength. When the strength of the aluminum pipe 143 is lowered, a pressing force for forming the contact heating portion N3 with the fixing roller 110 is less liable to be applied, so that a width of the contact heating portion N3 is smaller. When the width of the contact heating portion N3 is decreased, heat of the heating element 140 is less liable to be conducted to the fixing roller 110, so that a proper strength of the aluminum pipe 143 is required so as to ensure a necessary width of the contact heating portion N3 in order t shorten a rise time. In this embodiment, the aluminum pipe 143 has an outer diameter 18 mm and a thickness of t=1.0 mm and is pressed against the fixing roller 110 at a force of 117.6 N in a direction of an indicated arrow A1 by pressing springs provided at both longitudinal end portions of the aluminum pipe 143, thus forming a contact heating portion N3 having a width of 5 mm.

Figure 20:
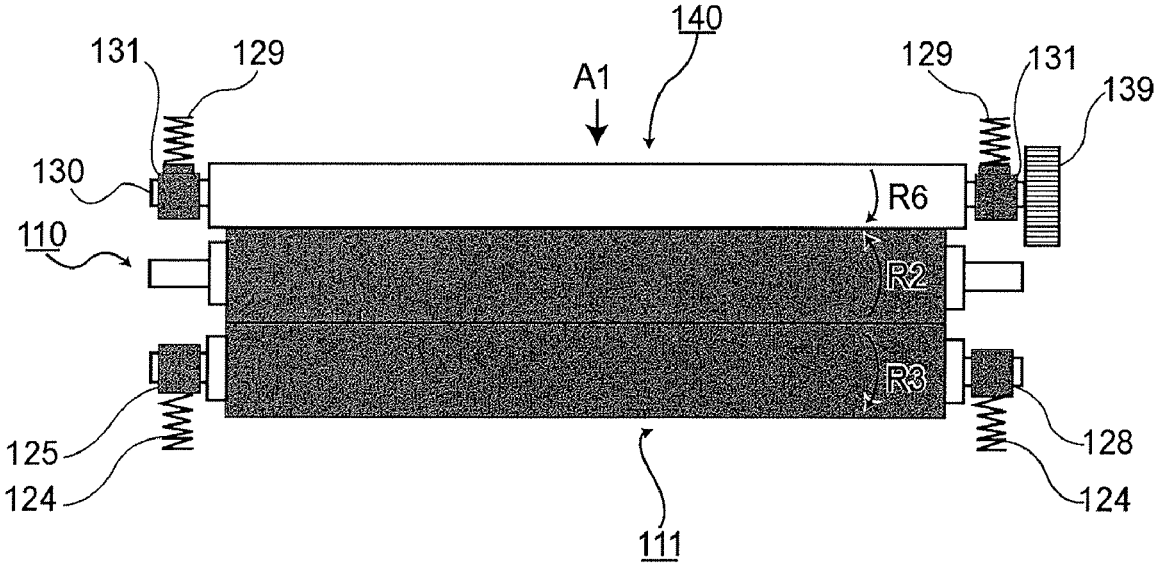
FIG. 20 is a front view of the image heating apparatus in Embodiment 4.

In the contact type surface image heating apparatus using a rotatable member such as the heat roller as the heating element, generally, the heating element does not slide on the fixing roller and is moved in a direction identical to the rotational direction of the fixing roller at the contact heating portion but in this embodiment, the surface of the heating element 140 is moved in a direction (arrow R6 direction) opposite from the surface movement direction of the fixing roller 110 at the contact heating portion N3. A front view as seen from a direction of an arrow A3 shown in FIG. 19 is shown in FIG. 20. The heating element has a shaft 130 at both longitudinal end portions thereof and is pressed against the fixing roller 110 in the arrow A1 direction by pressing springs 129 via bearings 131. At an end of the shaft 130 of the heating element, a heating element rotating gear 139 is provided and is rotationally driven by an unshown drive means. As a result, the heating element 140 is rotated so that the surface movement direction of the heating element 140 is opposite from the surface movement direction of the fixing roller 110, i.e., the arrow R6 direction.

In the case of a conventional roller-shaped surface image heating apparatus including a heating element containing a halogen lamp and contacting an outer peripheral surface of a fixing roller, when continuous printing is performed, contaminant such as paper dust or offset toner is deposited on the surface of the heating element in some cases. When the continuous printing is further continued and an amount of the contaminant exceeds a certain value, a large amount of the contaminant is transferred onto the fixing roller, so that a subsequent recording material to be conveyed can be contaminated. Further, in some cases, the contaminant at the surface of the heating element is continuously grown without being not transferred onto the fixing roller and heat transfer from heating elements to the fixing roller is inhibited by the contaminant, so that image failure such as fixation failure is caused to occur.

Figure 21:
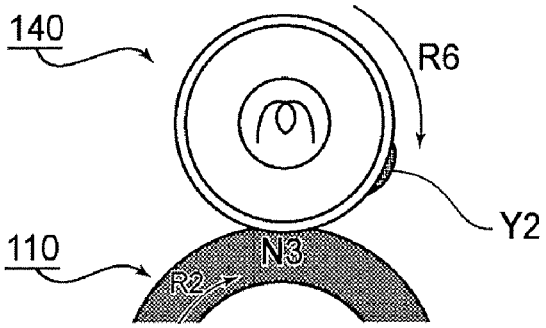
FIGS. 21 and 22 are schematic views each showing a process of transferring a contaminant deposited on a heating member onto a fixing roller in Embodiment 4.
Figure 22:
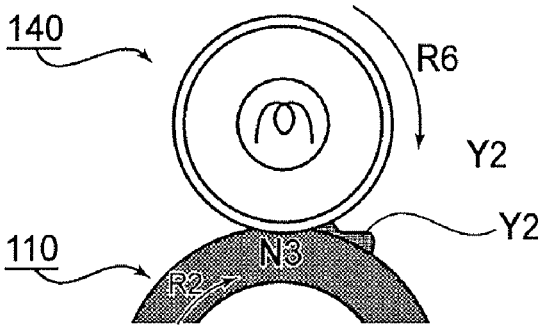

In the constitution of this embodiment, as described above, the surface of the heating element 140 is moved in the opposite direction from the surface movement direction of the fixing roller 110 at the contact heating portion N3. That is, the heating element 140 is rotated in the same direction as the rotational direction of the fixing roller 110. FIGS. 21 and 22 are enlarged views of the contact heating portion N3 and its neighborhood. As shown in FIG. 21, even in the case where the contaminant Y2 is deposited on the heating element 140, the surface of the heating element 140 is moved in the opposite direction from the surface movement direction of the fixing roller 110 (at the contact heating portion N3), so that the contaminant Y2 is removed by rubbing by the fixing roller 110 as shown in FIG. 22. The contaminant Y2 rubbing-removed by the fixing roller 110 can be discharged on the recording material P in the fixing nip N2 similarly as in Embodiment 3. In order to rubbing-remove the contaminant deposited on the heating element onto the fixing roller, the heating element surface must be basically moved in the opposite direction from the fixing roller surface movement direction at the contact heating portion. In this embodiment, during the rotation of the fixing roller 110, the heating element 140 is always rotated in the same direction as the rotational direction of the fixing roller 110, so that the surface of the heating element 140 is moved all the time in the opposite direction from the surface movement direction at the contact heating portion N3. In other words, at the contact heating portion N3, the fixing roller 110 is in such a state that it always rubs and removes the contaminant on the heating element 140, so that it is opposite to suppress deposition of the contaminant on the heating element 140.

The discharge of the contaminant on the surface of the heating element 140 by rotating the heating element 140 in the same direction as the rotational direction of the fixing roller 110 is performed onto the recording material P similarly as in Embodiment 3, so that the discharge may preferably be frequently performed so that the contaminant Y2 discharged on the recording material P is unnoticeable. In this embodiment, when the fixing roller 110 is rotated in the arrow R2 direction, the heating element 140 is always rotated (in the arrow R6 direction) in conjunction with the rotation of the fixing roller 110. For this reason, the surface contaminant of the heating element 140 is always rubbed and removed by the fixing roller 110 and can be unnoticeably discharged little by little on the recording material P.

The rotation speed of the heating element 140 relative to that of the fixing roller 110 achieves an effect of transferring the surface contaminant of the heating element 140 onto the fixing roller 110 even at a small value so long as the heating element 140 is rotated but an effect of rubbing and removing the contaminant on the fixing roller 110 is increased with a higher rotation speed. However, when the rotation speed of the heating element is excessively high, a rotational torque for rotating the heating element 140 is increased. For this reason, in this embodiment, the surface movement speed of the heating element 140 in the arrow R6 direction is 3 mm/sec.

As described above, according to the constitution of this embodiment, it is possible to unnoticeably discharge the contaminant deposited on the heating element surface little by little on the recording material P by rotating the heating element in the same direction as the fixing roller rotational direction so that the heating element surface is moved in the opposite direction from the fixing roller surface movement direction at the contact heating portion. As a result, it is possible to suppress the deposition of the contaminant on the heating element surface.

By using the above described constitution, a printing durability test was performed in the same manner as in Embodiment 3. In this embodiment, the heating element is always rotated in the same direction as the fixing roller rotational direction, so that the contaminant reaching the contact heating portion is always rubbed and removed by the fixing roller, thus being not accumulated on the heating element. As a result, there were no occurrences of image failure and fixation failure due to the contamination of the heating element even when the test was continued up to $10\times10^4$ sheets corresponding to the lifetime of the image forming apparatus.

In the constitution of this embodiment, when the fixing roller 110 is rotated, the rotation of the heating element 140 and the rotation of the fixing roller 110 are performed together so as to always rotate the heating element 140 but the heating element does not have to be always rotated. For example, when the toner on the recording material P is fixed, the heating element is reversely rotated in synchronism with the rotation of the fixing roller 110 so as to move the fixing roller surface and the heating element surface in the same direction. Further, only when the recording material P does not pass through the fixing nip N2, the heating element 140 may be rotated in the same direction as the rotational direction of the fixing roller 110 so that the fixing roller surface movement direction and the heat element surface movement are opposite from each other. As a result, it is possible to reduce the rotational torque when the toner on the recording material P is fixed. In addition, by rotating the heating element 140 in the same direction as the rotational direction of the fixing roller 110 when the recording material P does not pass through the fixing nip P, the contaminant can be transferred from the fixing roller 110 onto the pressing roller 111, thus being discharged on the back surface of the recording material P. Further, similarly as in Embodiment 3, by frequently performing the above described rotation operation of the heating element, e.g., every fixing of toner image on one sheet of the recording material, the contaminant may be unnoticeably discharged on the back surface of the recording material P. As another method, a mode for cleaning the surface of the heating element 140 by removing the contaminant is provided in advance and in this mode, the heating element 140 may be rotated in the same direction as the rotational direction of the fixing roller 110 at arbitrary timing by a user or automatically after a predetermined number of sheets are subjected to the fixing process.

Embodiment 5

In this embodiment, an image forming apparatus for forming an unfixed toner image is an ordinary image forming apparatus similarly as in Embodiment 3 and accordingly will not be described in detail. Further, also with respect to the sliding contact type surface image heating apparatus, members or means identical to those in Embodiment 3 are represented by identical reference numerals or symbols and omitted from explanation. A constitution of this embodiment is characterized in that a only a heat sliding layer is moved in a direction opposite from the fixing roller rotational direction at the contact heating portion. In this embodiment, the heat sliding layer corresponds to the heating member.

Figure 23:
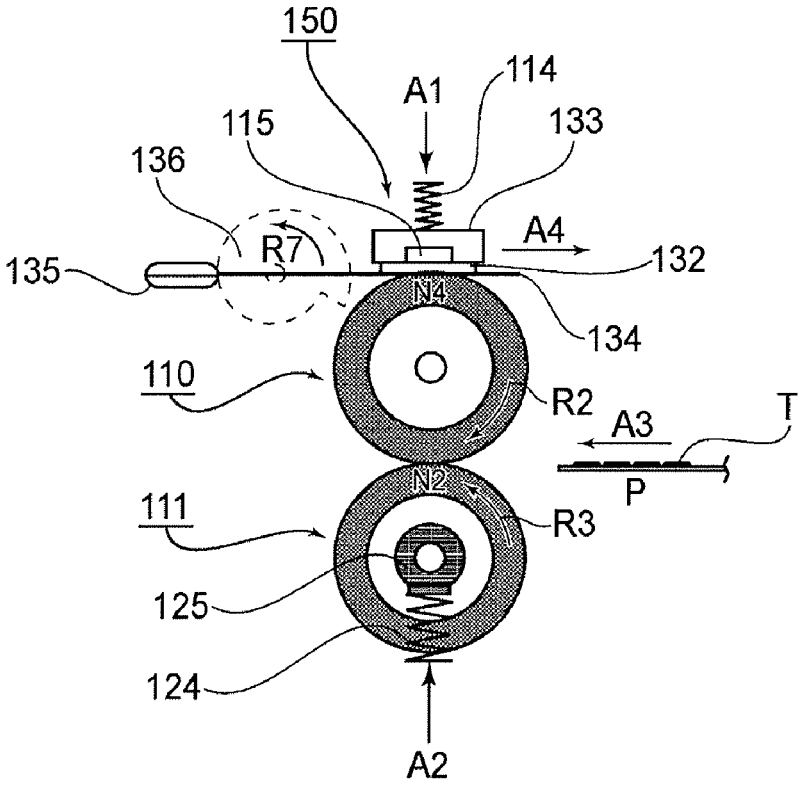
FIG. 23 is a constitutional view of an image heating apparatus in Embodiment 5.

A schematic view of a sliding contact type surface image heating apparatus in this embodiment is shown in FIG. 23. The fixing roller 110 and the pressing roller 111 are constituted similarly as in Embodiment 3, so that the pressing roller 111 is rotated in the arrow R3 direction by the rotation of the fixing roller 110 in the arrow R2 direction. A heating unit 150 for heating the fixing roller 110 contacts an outer peripheral surface of the fixing roller 110 to form a contact heating portion N4.

The heating unit 150 in this embodiment is constituted by a heater (hearing element) 132 as a heating source, a heater holder 133 which holds the heater 132, and a heat sliding layer 134 provided at a portion contacting the fixing roller 110.

In the constitution of this embodiment, the heat sliding layer 134 is movable in directions identical to and opposite from the fixing roller rotational direction and the heater holder 133 for holding the heater 132 is immovably fixed to the fixing apparatus. The heater holder 133 is pressed by pressing springs 114 in a direction indicated by an arrow A1 with a force of 117.6N to create the contact heating portion N4 having a width of 8 mm via the heat sliding layer 134. The heat sliding layer 134 includes a base metal material excellent in durability and heat conductivity. The base metal material is a 30 μm-thick stainless steel (SUS) sheet, on which surface a parting layer of PFA for suppressing the deposition of paper dust and toner is formed by coating. In this embodiment, such a constitution that the heater 132 and the heat sliding layer 134 are slidably moved together is employed, so that heat resistive silicone grease is applied between the heater 132 and the heat sliding layer 134 in order to decrease a frictional force therebetween and prevent wearing at a sliding portion. As a means other than the grease, it is also possible to form a layer of a material such as PTFE or PFA having a good slidability and heat resistivity, as a protective layer, at a contact sliding surface between the heater 132 and the heat sliding layer 134. In the case of forming the protective layer, the protective layer may preferably have a small thickness so as not to inhibit heat conduction from the heater 132 to the fixing roller 110 and may preferably be formed in a thickness of about 1-50 μm by coating or the like. The heat sliding layer 134 interposed between the heater 132 and the fixing roller 100 receives a frictional force in a direction indicated by an arrow A4 at the contact heating portion N4 when the fixing roller 110 is rotated in the arrow A2 direction. The heat sliding layer 134 is supported by a heat sliding layer supporting late 135 at an end portion upstream from the contact heating portion N4 in an entire longitudinal area at the end portion, and the heat sliding layer supporting plate 135 is supported by a heat sliding layer swingable cam 136 provided downstream from the heat sliding layer supporting late 135.

Figure 24:
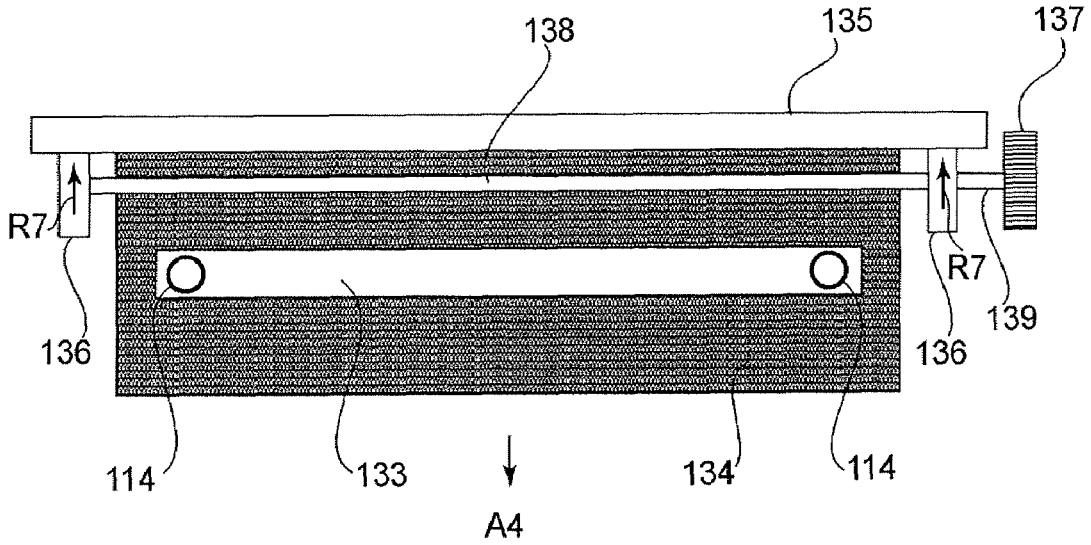
FIG. 24 is a top view of the image heating apparatus in Embodiment 5.

A schematic view of the fixing apparatus as seen from the arrow A1 direction shown in FIG. 23 is shown in FIG. 24. The cam 136 is provided about a cam shaft 139 at both longitudinal end portion of the heat sliding layer supporting pate 135. The cam 136 is rotated in a direction indicated by an arrow R7 by rotationally driving a cam rotating gear 137 provided at an end of the cam shaft 139 by an unshown driving means. The cam 136 has the same shape as that of the heat element swingable cam 141 in Embodiment 3 and specifically has such a shape that a radius is gradually increased from a minimum radius of 10 mm to a maximum radius of 14 mm. By rotating the cam 136 in the arrow R7 direction when the heat sliding layer 134 receives a frictional force in an arrow A4 direction by rotation of the fixing roller 110 in the arrow R2 direction, similarly as in the heating unit 112 in Embodiment 3, the heat sliding layer 134 is reciprocated in directions identical to and opposite from the fixing roller rotational direction.

Figure 25:
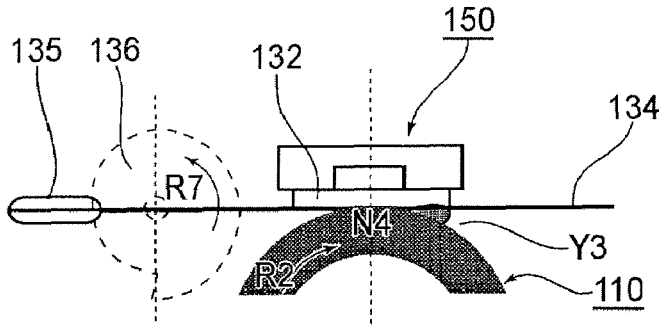
FIGS. 25 and 26 are schematic views each showing a process of transferring a contaminant deposited on a heating member onto a fixing roller in Embodiment 5.
Figure 26:
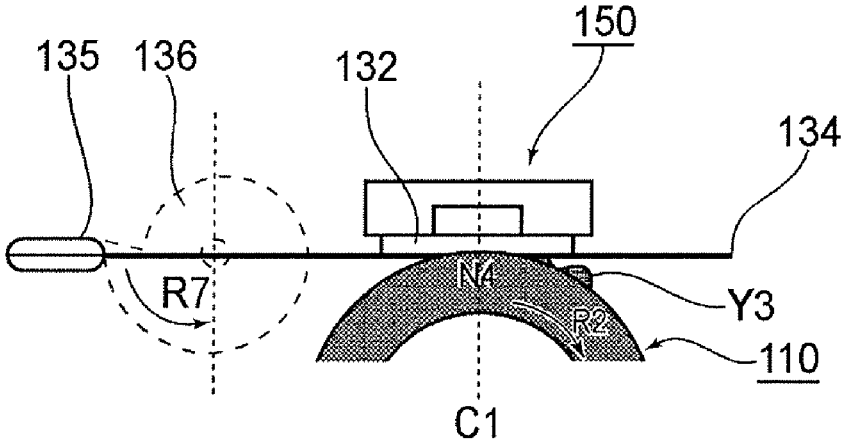

FIGS. 25 and 26 are enlarged views showing the contact heating portion N4 and its neighborhood, wherein FIG. 25 shows a first position and FIG. 26 shows a second position. Even in the case where a contaminant Y3 is deposited on the heat sliding layer 134 as shown in FIG. 25, when the fixing roller 110 is rotated in the arrow R2 direction, the cam 136 is rotated in the arrow R7 direction and the heat sliding layer 134 is moved in the opposite direction from the fixing roller rotational direction. As a result, as shown in FIG. 26, the contaminant Y3 of the heat sliding layer 134 is rubbed and removed by the fixing roller 110. The contaminant Y3 rubbed and removed by the fixing roller 110 can be discharged, similarly as in Embodiment 3, on the recording material P in the fixing nip N2.

The timing of movement of the heat sliding layer 134 and the timing of conveyance of the recording material P in this embodiment are identical to those with respect to the heating unit 112 and the recording material P in Embodiment 3. More specifically, when the recording material P passes through the fixing nip N2, the heat sliding layer 134 is always moved in the opposite direction from the fixing roller rotational direction, so that the contaminant Y3 is not accumulated at a portion downstream from the contact heating portion N4.

In the constitution of this embodiment, it is possible to remove the contaminant remaining at the contact heating portion N4 by moving only the heat sliding layer 134 without moving the heater 132. For this reason, a center line of the heater 132 and a center line of the fixing roller 110 are not deviated from each other, so that the energized heat generating resistor layer of the heater 132 does not come out of the contact heating portion N4. For this reason, a width of the energized heat generating resistor layer can be increased up to a width of the contact heating portion N4. A wider energized heat generating resistor layer is caused to contact the fixing roller 110 is more liable to heat the surface of the fixing roller 110, thus shortening a rise time. In this embodiment, the width of the energized heat generating resistor layer of the heater 132 is equal to the width of the contact heating portion N4 and specifically is 8 mm, so that the surface of the fixing roller 110 can be heated in a shorter time.

By using the above described constitution, a printing durability test was performed in the same manner as in Embodiment 3. In this embodiment, the heat sliding layer is moved in the opposite direction from the fixing roller rotational direction during the passage of the recording material through the fixing nip, so that the contaminant reaching the contact heating portion is always rubbed and removed by the fixing roller, thus being not accumulated on the contact heating portion. As a result, there were no occurrences of image failure and fixation failure due to the contamination of the contact heating portion even when the test was continued up to $10\times10^4$ sheets corresponding to the lifetime of the image forming apparatus.

Similarly as in Embodiment 3, also in the constitution of this embodiment, timing, speed, and frequency for moving the heat sliding layer 134 are not limited to those described above. Further, the method of moving the heat sliding layer 134 is also not limited to the above described method using the cam but may also be changed to other methods. Also in these methods, similar function and effect can be achieved so long as the heat sliding layer 134 is moved in the opposite direction from the fixing roller rotational direction during the rotation of the fixing roller 110.

Embodiment 6

In this embodiment, an image forming apparatus for forming an unfixed toner image is an ordinary image forming apparatus similarly as in Embodiment 3 and accordingly will not be described in detail. Further, also with respect to the sliding contact type surface image heating apparatus, members or means identical to those in Embodiment 3 are represented by identical reference numerals or symbols and omitted from explanation.

In the constitution described in Embodiment 5, the heat sliding layer is reciprocated in directions identical to and opposite from the fixing roller rotational direction but in the constitution of this embodiment, a belt-like heat sliding layer is used and similarly as in the case of the heating element 140 in Embodiment 4, the surface of the belt-like heat sliding layer is moved in the opposite direction from the fixing roller surface movement direction to prevent contamination of the heat sliding layer.

Figure 27:
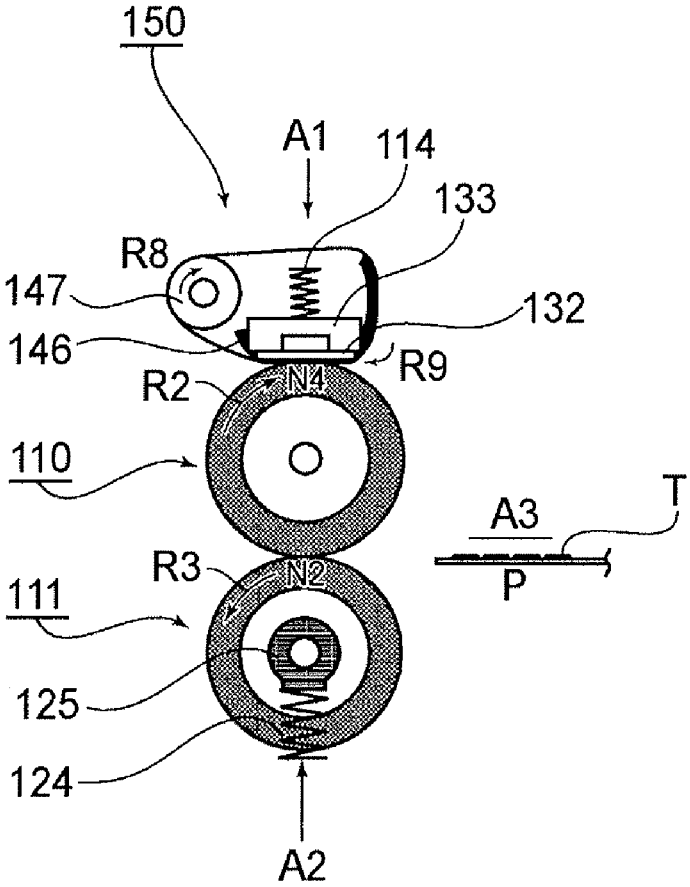
FIG. 27 is a constitutional view of the image heating apparatus in Embodiment 6.

FIG. 27 is a schematic view of the fixing apparatus of this embodiment. A heat sliding belt 145 as the heat sliding layer is stretched about a belt guide 146 and a belt rotating roller 147. Similarly as in the case of the heat sliding layer 134 in Embodiment 5, a base metal material of the belt 145 is a 30 μm-thick stainless steel (SUS) belt, on which surface a parting layer of PFA for preventing the deposition of paper dust and toner is coated. In this embodiment, such a constitution that the heater 132 and the heat sliding belt 145 are slidably moved together is employed similarly as in Embodiment 5, so that heat resistive silicone grease is applied between the heater 132 and the heat sliding belt 145 in order to decrease a frictional force therebetween and prevent wearing at a sliding portion. As a means other than the grease, it is also possible to form a layer of a material such as PTFE or PFA having a good slidability and heat resistivity, as a protective layer, at a contact sliding surface between the heater 132 and the heat sliding belt 145. In the case of forming the protective layer, the protective layer may preferably have a small thickness so as not to inhibit heat conduction from the heater 132 to the fixing roller 110 and may preferably be formed in a thickness of about 1-50 μm by coating or the like. The belt rotating roller 147 is formed of foamed silicone rubber similarly as in the elastic layer of the fixing roller 110 and is rotated in a direction indicated by an arrow R9 to rotationally move the heat sliding belt 145 in a direction indicated by an arrow R9. Similarly as in the case of the heating element 140 in Embodiment 4, the rotations of the fixing roller 110 and the belt rotating roller 147 are performed together, so that the heat sliding belt 145 is rotated in the direction (arrow R9 direction) identical to the rotational direction (arrow R2 direction) of the fixing roller 110 during the rotation of the fixing roller 110. For this reason, the contaminant reaching the contact heating portion N4 by the printing operation is rubbed and removed by the fixing roller 110.

In the constitution of this embodiment, during the rotation of the fixing roller 110, the surface of the heating element (heat sliding belt 145) is always moved in the opposite direction from the surface movement direction of the fixing roller 110 similarly as in Embodiment 4, so that the surface of the heating element is moved all the time in the opposite direction from the surface movement direction at the contact heating portion N4. In other words, at the contact heating portion N3, the fixing roller 110 is in such a state that it always rubs and removes the contaminant on the heat sliding belt 145, so that it is opposite to suppress deposition of the contaminant on the heat sliding belt 145. Further, the heat sliding layer is a thin belt, so that it has a smaller thermal capacity than that of the metal pipe in Embodiment 4 and also has a flexibility, thus being liable to form a desired width of the contact heating portion N4. For this reason, heat from the thermal source is liable to be conducted to the fixing roller 110, so that a rise time of the fixing roller 110 can be shortened.

By using the above described constitution, a printing durability test was performed in the same manner as in Embodiment 3. In this embodiment, the surface of the heat sliding belt 145 is moved always in the opposite direction from the surface movement direction of the fixing roller 110 at the contact heating portion N4, so that the contaminant reaching the contact heating portion N4 is always rubbed and removed by the fixing roller 110, thus being not accumulated on the heat sliding belt 145. As a result, there were no occurrences of image failure and fixation failure due to the contamination of the contact heating portion even when the test was continued up to $10\times10^4$ sheets corresponding to the lifetime of the image forming apparatus.

Similarly as in Embodiment 4, also in the constitution of this embodiment, timing, speed, and frequency for moving the heat sliding belt 145 are not limited to those described above. Further, the method of rotating the heat sliding belt 145 in the same direction as the fixing roller rotational direction is also not limited to the above described method using the driving roller. Also in other equivalent methods, similar function and effect can be achieved.

In Embodiments 3 to 6 described above, the removal of the contaminant of the heating member (or the heating unit) is described. As the pressing member for forming the fixing nip N2, it is also possible to use a nonrotating pad member other than the roller.

Further, the fixing apparatus to be mounted in the image forming apparatus is described in Embodiments 1 to 6 but the present invention is also applicable to an image heating apparatus such as a gloss-imparting apparatus for improving glossiness by re-heating a recording material carrying thereon a toner image which has been fixed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 204238/2006 filed Jul. 27, 2006, 332176/2006 filed Dec. 8, 2006, and 184600/2007 filed Jul. 13, 2007, which are hereby incorporated by reference.

What is claimed is:

1. An image heating apparatus for heating a toner image formed on a recording material, comprising:

a roller contactable with a toner image carrying surface of the recording material;

a heating member for heating said roller, said heating member contacting a surface of said roller, wherein the toner image formed on the recording material is heated in contact with said roller; and a driving mechanism for moving said heating member to a first position contacting said roller, and a second position contacting said roller different from the first position with respect to a tangential direction of said roller, wherein the second position is located upstream from the first position with respect to a rotational direction of said roller during heating of the toner image, and wherein said heating member is located at the first position during the heating of the toner image and moved from the first position to the second position during a period other than a period for the heating of the toner image.

2. An apparatus according to claim 1, wherein said roller is rotatable normally and reversely and constitutes a part of said driving mechanism, and said heating member is moved to the first position or the second position depending on a force exerted thereon from said roller.

3. An apparatus according to claim 1, wherein said driving mechanism includes said roller for moving said heating member to the first position and an urging member for moving said heating member to the second position.

4. An apparatus according to claim 3, wherein said heating member is moved to the first position against an urging force of said urging member by receiving a force from said roller when said roller is rotated, and is moved to the second position by the urging force of the urging member when said roller is stopped.

5. An apparatus according to claim 1, wherein said heating member is held by a holder and a gap for moving said heating member to the first position and the second position is provided between said holder and said heating member.

6. An image heating apparatus for heating a toner image formed on a recording material, comprising;

a roller contactable with a toner image carrying surface of the recording material;

a heating member for heating said roller, said heating member contacting a surface of said roller, wherein the toner image formed on the recording material is heated in contact with said roller; and a driving mechanism for moving said heating member to a first position contacting said roller and a second position, contacting said roller different from the first position with respect to a tangential direction of said roller;

wherein said heating member includes a substrate and a heat generating resistor formed on the substrate and the heat generating resistor is located in a contact area between said heating member and said roller both when said heating member is located at the first position and when said heating member is located at the second position.

* * * * *